United States Patent [19]

Alles

[11] 4,201,105

[45] May 6, 1980

[54] REAL TIME DIGITAL SOUND SYNTHESIZER

[75] Inventor: Harold G. Alles, Bridgewater, N.J.

[73] Assignee: Bell Telephone Laboratories, Incorporated, Murray Hill, N.J.

[21] Appl. No.: 901,489

[22] Filed: May 1, 1978

[51] Int. Cl.[2] ..... G10H 5/10; G10H 5/02

[52] U.S. Cl. ..... 84/1.01; 84/1.25; 84/1.26; 84/1.27; 364/719; 364/721

[58] Field of Search ..... 84/1.01, 1.03, 1.24, 84/1.25, 1.26, 1.27; 364/607, 608, 718, 721, 719

[56] References Cited

U.S. PATENT DOCUMENTS

| | | | |
|---|---|---|---|
| 3,662,160 | 5/1972 | Hoppes . | |
| 3,727,037 | 4/1973 | Zorn . | |
| 3,821,714 | 6/1974 | Tomisawa | 84/1.01 |
| 3,823,390 | 7/1974 | Tomisawa | 84/1.01 |
| 3,882,751 | 5/1975 | Tomisawa | 84/1.01 |
| 3,913,442 | 10/1975 | Deutsch | 84/1.26 |
| 3,915,047 | 10/1975 | Davis | 84/1.03 |
| 3,970,998 | 7/1976 | Weisbecker . | |
| 4,018,121 | 4/1977 | Chowning | 84/1.01 |
| 4,036,096 | 7/1977 | Tomisawa | 84/1.01 |
| 4,085,644 | 4/1978 | Deutsch | 84/1.03 |
| 4,114,496 | 9/1978 | Deutsch | 84/1.27 |
| 4,133,241 | 1/1979 | Niimi | 84/1.01 |
| 4,135,427 | 1/1979 | Deutsch | 84/1.24 |
| 4,149,440 | 4/1979 | Deforeit | 84/1.01 |

OTHER PUBLICATIONS

Max V. Mathews, *The Technology of Computer Music*, 1969, pp. 37–39, 46–53 and 116–120.

Mathews, M. V., "Groove—A Program to Compose, Store and Edit Functions of Time," pp. 715–721, Communications of the ACM, Dec. 1970.

Alles, H. G., "A One-Card 64 Channel Digital Synthesizer," Computer Music Journal, Nov. 1977, pp. 7–9.

Alles, H. G., "A Portable Digital Sound Synthesis System," Computer Music Journal, Nov. 1977, pp. 5–6.

Moorer, J. A., "Signal Processing Aspects of Computer Music—A Survey," Computer Music Journal, Feb. 1977, pp. 4, 5, 32–35.

Beauchamp, J., "The TI 980A Computer-Controlled Music Synthesizer," Proceedings of the Second Annual Music Computation Conference, Nov. 1975, pp. 1, 2, 19–33.

Alles, H. G., "A Hardware Digital Music Synthesizer," Eascon '75 Record, Sep. 1975, pp. 217A–217E.

*Primary Examiner*—J. V. Truhe

*Assistant Examiner*—William L. Feeney

*Attorney, Agent, or Firm*—Charles Scott Phelan; Charles Scott Phelan

[57] ABSTRACT

Linearly binary-coded digital control signals representing specific time segments of musical sounds are used in part to control stepped ramp signal generators in a digital synthesizer which runs continuously on a fixed program. The ramp signals are used to control amplitude and frequency parameters of multiple digital oscillators that produce respective constituent tones of the musical sound segments. The synthesizer is operable in response to time-multiplexed digital control signals for multiple musical voices, one voice portion of which is also being computed in real time for multiplexing with previously computed and stored digital control signals for other voices. The indicated computations are effected by known techniques on a commercially available computer to translate performer-actuated transducer output signals, designating notes of a composition, into the aforementioned binary-coded digital control signals.

27 Claims, 16 Drawing Figures

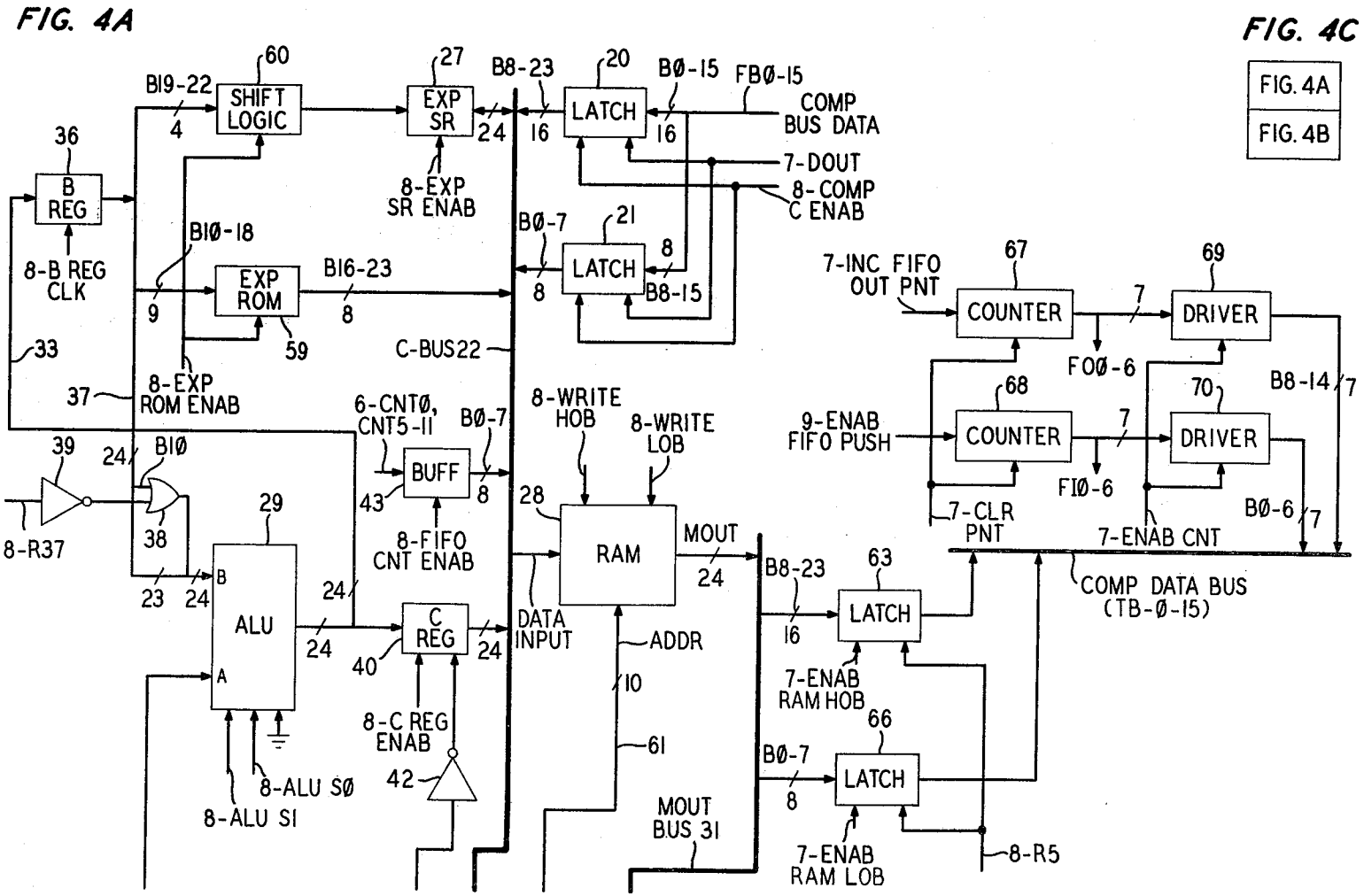
FIG. 4C
FIG. 4A
FIG. 4B
DRIVER
DRIVER
COUNTER
COUNTER
B8-14
BØ-6
7-ENAB CNT
COMP DATA BUS (TB-Ø-15)
FOØ-6
FIØ-6
7-CLR PNT
7-INC FIFO OUT PNT
9-ENAB FIFO PUSH
8-R5
LATCH
LATCH
7-ENAB RAM HOB
7-ENAB RAM LOB
B8-23
BØ-7
COMP BUS DATA
7-DOUT
8-COMP C ENAB
FBØ-15
BØ-15
B8-15
LATCH
LATCH
8-WRITE LOB
8-WRITE HOB
RAM
MOUT
ADDR
DATA INPUT
MOUT BUS 31
EXP SR
8-EXP SR ENAB
C-BUS22
BUFF
8-FIFO CNT ENAB
C REG
8-C REG ENAB
6-CNTØ, CNT5-11
SHIFT LOGIC
EXP ROM
BI6-23
BIØ-18
8-EXP ROM ENAB
BI9-22
ALU
8-ALU SØ
8-ALU SI
B REG
8-B REG CLK
BIØ
8-R37

FIG. 11

| R TIMES | RAM 28 ADDRESS | A REG | B REG | C REG | ALU FUNCTION | WAVE FORM MEM RAS | WAVE FORM MEM CAS | MPY X CLK | CKS Y | M & L | CLK | SWITCH MEMORY ADDRESS |
|---|---|---|---|---|---|---|---|---|---|---|---|---|
| Φ | REFRESH PHASE | | | INCREMENTED REFRESH PHASE | | | | | | | | |
| 1 | CURRENT RAMP VAL | | | | CLEAR | | | | | | | |
| 2 | RAMP INC | CURRENT RAMP VAL | ZERO | | A+B | | | | | | | |
| 3 | FINAL RAMP VAL | RAMP INC | CURRENT RAMP VAL | | A+B | | | | | | | |
| 4 | A OSC CONTROL | FINAL RAMP VAL | INCREMENTED RAMP | INCREMENTED RAMP VAL | A-B | | | | | | | |
| 5 | COMP 13 ACCESS | FINAL RAMP VAL | INCREMENTED RAMP | INCREMENTED RAMP VAL | CLEAR | | | | | | | |
| 6 | A OSC Φ | FINAL RAMP VAL | ZERO | INCREMENTED RAMP VAL | A+B | | | | | | | A OSC FM |
| 7 | CURRENT RAMP VAL | A OSC FM | ZERO | NEW CURRENT RAMP VAL | A+B | | | | | | | A OSC OPTION |
| 10 | A OSC Δ Φ | A OSC Φ | A OSC FM | | A+B | | | | | | | C ADD INPUT |
| 11 | A OSC COEF | A OSC Δ Φ | Φ+FM | | A+B | | | | | | | C ADD INPUT |
| 12 | B OSC CONTROL | A OSC COEF | | Φ+FM+ Δ Φ | A+B | | | | | | | C ADD OUTPUT |
| 13 | A OSC Φ | | | | CLEAR | | | | | | | B OSC FM |
| 14 | B OSC Φ | B OSC FM | ZERO | | A+B | | | | | | | B OSC OPTION |
| 15 | B OSC Δ Φ | B OSC Φ | B OSC FM | | A+B | | | | | | | D ADD INPUT |
| 16 | B OSC COEF | B OSC Δ Φ | Φ +FM | | A+B | | | | | | | D ADD INPUT |
| 17 | B OSC Φ | B OSC COEF | | Φ+FM+ Δ Φ | A+B | | | | | | | D ADD OUTPUT |
| 20 | C OSC CONTROL | | | | | | | | | | | |
| 21 | RAMP CONTROL | | | | CLEAR | | | | | | | C OSC FM |
| 22 | C OSC Φ | C OSC FM | ZERO | | A+B | | | | | | | C OSC OPTION |
| 23 | C OSC Δ Φ | C OSC Φ | C OSC FM | | A+B | | | | | | | A ADD INPUT |
| 24 | C OSC COEF | C OSC Δ Φ | Φ +FM | | A+B | | | | | | | A ADD INPUT |
| 25 | C OSC Φ | C OSC COEF | | Φ+FM+ Δ Φ | | | | | | | | A ADD OUTPUT |
| 26 | D OSC CONTROL | | | | | | | | | | | |
| 27 | RAMP CONTROL | | | | CLEAR | | | | | | | D OSC FM |
| 30 | D OSC Φ | D OSC FM | ZERO | | | | | | | | | D OSC OPTION |
| 31 | D OSC Δ Φ | D OSC Φ | D OSC FM INPUT | | | | | | | | | B ADD INPUT |
| 32 | D OSC COEF | D OSC Δ Φ | Φ +FM | | A+B | | | | | | | B ADD INPUT |
| 33 | D OSC Φ | D OSC COEF | | Φ+FM+ Δ Φ | A+B | | | | | | | B ADD OUTPUT |
| 34 | CURRENT RAMP VAL | | | | CLEAR | | | | | | | |
| 35 | REFRESH PHASE | CURRENT RAMP VAL | ZERO | | A+B | | | | | | | |
| 36 | FIFO PUSH | REFRESH PHASE | | CURRENT RAMP VAL | A+B | | | | | | | |
| 37 | RAMP OUTPUT | | +1 ADDRESS | TRUE OR EXP RAMP VAL | A+B | | | | | | | |

WRITE TO MEMORY

CONDITIONAL WRITE TO MEMORY

CLK REGISTER

OPTIONAL C REG CLK

WAVEFORM ADDRESS LATCH CLK

WRITE TO SWITCH MEMORY

REAL TIME DIGITAL SOUND SYNTHESIZER

BACKGROUND OF THE INVENTION

1. Field of the Invention

This invention relates to digital sound synthesizers, and more particularly, to such synthesizers which are useful for synthesizing, for example, the real time production of musical sounds.

2. Description of the Prior Art

The synthesizer to be described herein will be described, without limitation on its possible applications, in terms of a music synthesizer because that is one of the more difficult applications thereof. Such machines are, however, also known to be useful, e.g., for performing such functions as speech synthesis and sound effect synthesis.

It is known in the art to synthesize musical sounds which either are substantially similar to those of conventional musical instruments, or are different from the sounds of such instruments, without resort to such conventional instruments. The equipment used for synthesizing takes many forms. In one of those forms a performer actuates an input transducer to define a selected note and its duration in a composition. Such transducers may include, e.g., a keyboard, slide switches, joy sticks, or others. A computer is used to translate signals from the input transducer into differently coded signals representing the same information but in terms of corresponding signals for controlling a synthesizer circuit to generate signals representing the selected note in accordance with a performer-selected instrumental voice. "GROOVE—A Program to Compose, Store, and Edit Functions of Time" by M.V. Mathews and F.R. More, *Communications of the ACM,* Vol. 13, No. 7, December 1970, pages 715–721, indicates one such system using an undisclosed analog synthesizer.

Although the known type of computer translation can be readily carried out on a real time basis, synthesizers heretofore available have been unable to be controlled for operation on a like-real-time basis for producing sound approaching the complexity of sound producing sound approaching the complexity of sound produced by a small orchestra, e.g., 10 to 15 instruments, playing any of various kinds of music. Such an involved performance is herein called a score-real-time, or soundreal-time, operation that would provide essentially immediate audible feedback so that a composition can be played in real musical time by the performer.

Clearly, there are existing synthesizing structures, e.g., the Mathews et al. GROOVE-controlled system, available which can produce score-real-time outputs. However, those systems are subject to various infirmities such as working in terms of unique sounds lacking the richness of sounds of conventional musical instruments, or requiring magnificent analog or digital structures which involve room-size installations and are conveniently operable by most artistic performers only with close cooperation of skilled technicians.

Most prior art synthesizers have utilized concepts such as using separate circuit modules for different voices or even different note ranges. There have also been speculative suggestions in the literature for using separate modules for executing different ones of the constituent functions involved in particular synthesizing algorithms and of the possibility for time-sharing some modules. However, the enabling information as to such speculative suggestions has not been similarly available for operative apparatus.

It is, therefore, one object of the present invention to improve sound synthesizing systems.

It is another object to reduce the size and cost of synthesizer systems.

A further object is to synthesize more voices of a musical score than had been heretofore possible on a substantially simultaneous score-real-time basis.

SUMMARY OF THE INVENTION

The foregoing and other objects of the invention are realized in one illustrative embodiment in which ramp signal generating circuits, responsive to time-multiplexed sets of computed control signals for different voices, produce sets of digital amplitude control signals. The latter control signals are applied to control the operation of digital oscillator circuits which generate digital output signals representing analog samples of respective constituent tones of an ultimate composite analog sound. Such digital tone signals are combined and coupled through digital-to-analog converters to loudspeakers.

It is one feature of the invention that digital oscillator circuits cooperate with arithmetic and logic circuits and random access memory for operation on a time-shared basis under control of a short, recurrently employed microprogram to function as a plurality of controlled digital oscillators.

It is another feature that input-coded digital signal comprise time-division multiplexed sets of such signals for a currently executed musical voice and at least one previously executed and stored voice. Such multiplexed voice signals operate the digital oscillator circuits to produce in score-real-time the composite multivoice performance of a musical score.

Another feature of one embodiment of the invention is the employment of a first-in-first-out register stack system for queueing indications of ramp function completions to indicate a readiness to receive additional ramp-specifying information for processing further time segments of a desired output sound sequence.

Yet another feature is the provision of exponentiation circuits which are selectably available to cause output sound variations to occur in accordance with a rule for exponentially changing sound rather than a rule for linearly changing sound for more faithful synthesis of certain acoustic effects.

BRIEF DESCRIPTION OF THE DRAWING

A more complete understanding of the invention and its various features, objects, and advantages may be obtained from a consideration of the following detailed description in connection with the appended claims and the attached drawing in which

FIGS. 4A–4C (hereinafter usually referenced as FIG. 4) comprise a data flow block diagram of one embodiment of a synthesizer used in the system of FIG. 1;

FIG. 11 is a timing diagram illustrating the synthesizer recurrent program sequence.

DETAILED DESCRIPTION

Figure 1:
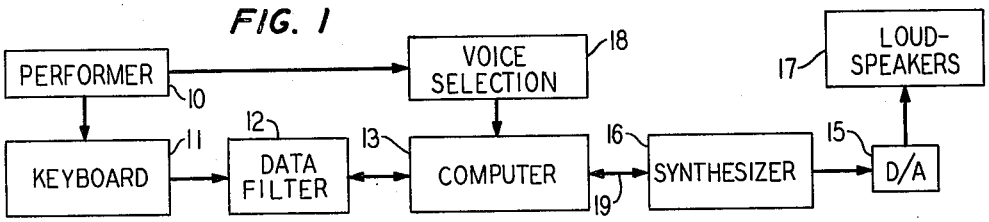
FIG. 1 is a block diagram of a music-generating system utilizing the present invention.

In FIG. 1 a performer 10 operates one or more suitable transducers, such as a keyboard 11, for producing digital signals indicating selected musical notes and the duration of the selection thereof. One example of such a transducer is the keyboard and associated logic disclosed in my copending application Ser. No. 798,161 filed May 18, 1977, entitled "Multidevice Position Digital Encoder" and assigned to the same assignee as the present application. That type of keyboard system indicates not only the notes selected at a given time and the duration of the selection, but it also provides information as to the position of each key of the board at each of a plurality of recurring instants. Thus, in the case of a selected note, the position information provides attack and decay data as to the performer actuation of the selected key.

A data filter 12 is advantageously utilized to couple the output of keyboard 11 to a computer 13. The data filter, or choke, is advantageously that disclosed in my copending application Ser. No. 829,010 filed Aug. 30, 9177, entitled "PCM Data Throttle", now U.S. Pat. No. 4,129,751, and assigned to the same assignee as the present application. Such a filter not only eliminates redundant data prior to transmission to the computer 13, but it also has the capability for changing a data significance threshold which is used for screening out position signal changes of less significance than such threshold. Thus, the computer is able to perceive a flow of data to it which is greater than its data handling capability during a particularly rapid operation of the keyboard by the performer; and in response to such perception, transmit signals back to the data filter 12 for increasing the threshold and thereby reducing the flow of data. For example, one known technique is for computer 13 to receive data through a first-in-first-out (FIFO) type of buffer and raise or lower the filter threshold when the difference between input and output pointers is greater than a first value or less than a second value, respectively.

The computer 13 is advantageously a commercially available computer, such as for example, the LSI-11 microcomputer with associated hardware as marketed by the Digital Equipment Corporation and described in considerable detail as to hardware, operation, processor organization, and system software in the *DIGITAL MICROCOMPUTER HANDBOOK*, published by the Digital Equipment Corporation under data of 1976. Computer 13 is used to translate the digitally coded key position signals provided from data filter 12 into linearly coded digital signals representing the same information but in terms of corresponding signals for controlling a digital synthesizing circuit 16. The latter circuit advantageously generates linear pulse-code modulated signals representing analog sample amplitudes defining the notes selected by the performer's operation of keyboard 11 and in accordance with a performer selected instrumental voice. Such selection is advantageously effected by voice selection logic 18 which is, for example, a teletypewriter-type keyboard. Those coded sample output signals from synthesizer 16 are typically coupled through at least one digital-to-analog converter 15 prior to coupling of the resulting analog signals to suitable loudspeakers 17.

Synthesizer 16 advantageously operates in response to input signals representing piecewise amplitude ramp segments of a characteristic note sound envelope pattern for a particular selected instrumental voice. It also responds to signals representing ramp segments defining frequency composition of each selected note for that voice. Computer algorithms for producing control signals of this general type defining parameters of constituent functions to be utilized in synthesizing individual notes are well known in the art. Such algorithms operate on commercially available general purpose computers with ample speed for individual instrumental voices to permit the operation of the synthesizer 16 of the present invention sufficiently rapidly to provide real time audible output feedback to the performer 10 for the instrumental voice which he is currently executing, as well as for previously executed and stored instrumental voices.

One example of a code translating lgorithm is found in the "Music V Manual" which appears as Chapter 3 of the *Technology of Computer Music* by M. V. Mathews et al., The M.I.T. Press, Cambridge, Mass., 1969. That manual describes the process from score (transducer) input digital information to output pulse-coded analog sample data on magnetic tape, but the Pass I and Pass II portions indicated, e.g., in the FIG. 48 process block diagram and otherwise explained throughout the book depict the program concepts defining one implementation for the programming of computer 13 herein. The Music V algorithm defines note segments in terms of the duration of each segment, and the illustrative embodiment described herein defines them in terms of initial and final amplitude values and rates of change, but that is a matter only of user coordinate selection for a common piece of information having both amplitude and time parameters.

A characteristic of the operation of computer 13 is that while computing the synthesizer control signals for an individual musical voice, those control signals are simultaneously sent to synthesizer 16 and stored in memory, not separately shown but included in the schematic representation of the computer 13. As the computer outputs control signals for a currently executed voice, it advantageously simultaneously time multiplexes therewith corresponding signals from previously computed voices contained in memory files selected by performer 10 through logic 18.

An address and data bus 19 couples to the synthesizer 16 digitally coded signals defining amplitude and frequency ramps for each of its multiple generators for a segment of a sound pattern. These definitions include an initial (or current) value of the ramp, a rate of change (or increment) value for the ramp, a final value, and a ramp control word. Any or all of those four ramp-defining items are modified or replaced for each subsequent piecewise segment of the pattern.

Figure 2:
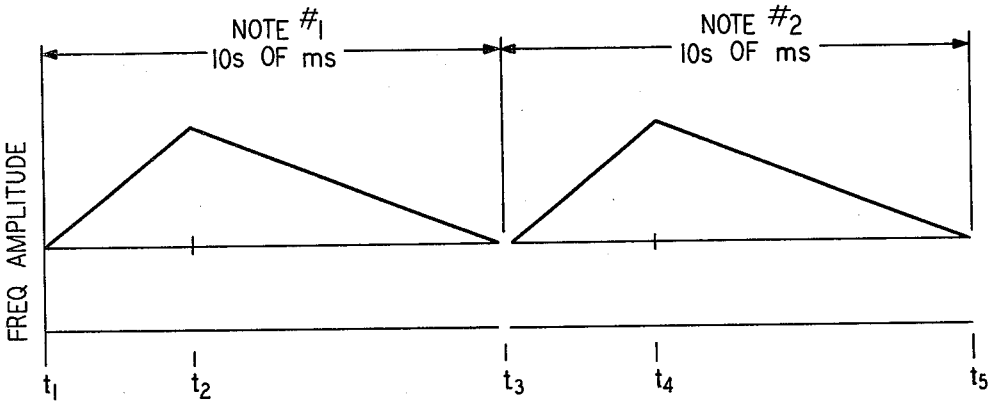
FIG. 2 includes amplitude-versus-time and frequency-versus-time diagrams for facilitating a description of the operation of the present invention.

FIG. 2 illustrates a succession of two notes (assumed to be of equal duration for purpose of illustration) of a composition utilizing a voice which is assumed to be definable by a triangular amplitude wave for purposes of simplifying the description of the synthesizing invention. It will, however, become apparent that piecewise approximation segments of voices characterized by much more complex patterns are readily synthesized in the same fashion. Each not has a duration that is typically some tens of milliseconds extending from time $t_1$ to time $t_3$ for note 1 and from time $t_3$ to time $t_5$ for note 2. Each note is here assumed to have the same envelope evidencing the aforementioned triangular pattern peaking at times $t_2$ and $t_4$, respectively. Similarly, each of the two notes is assumed to be represented by a constant frequency. However, it will also become evident that that is not a necessary assumption and note frequency is also variable in a fashion that is defined by a similar ramp technique.

It must be recognized that along the time scale in FIG. 2 the illustrated note ramp segments are by computer 13 advantageously broken into many processing samples which are interleaved with samples of other voices on the bus 19 and in synthesizer 16. At the start of the note 1 of a given voice, computer 13 loads into synthesizer 16 the aforementioned specifications for the amplitude and frequency ramps thereof. This loading operation of the synthesizer 16, as will be described; but on the time scale of FIG. 2 the loading appears to take place essentially at the beginning of each note segment. Following the loading, each ramp runs to the end thereof as indicated by attainment of the aforementioned final value; and the synthesizer 16 signals computer 13 that the ramp function has been completed and the synthesizer is ready for more information relating to the next segment of the note.

Figure 3:
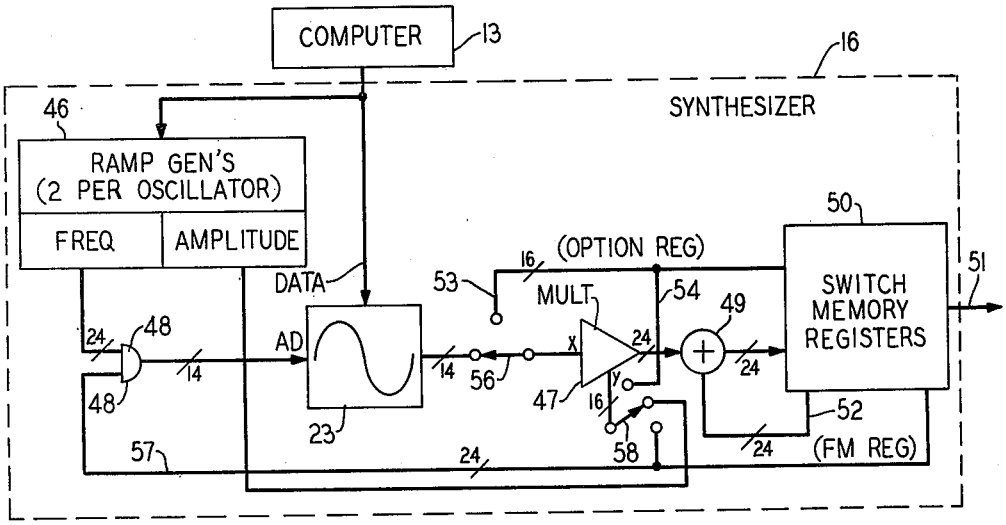
FIG. 3 is a functional block diagram of a synthesizer used in the system of FIG. 1.

The aforementioned introductory outline description of the synthesizer operation typically runs through thousands of basic synthesizer program cycles during the course of a single piecewise ramp segment of the note pattern. Groups of those cycles taken together will be shown to operate advantageously as 64 time-multiplexed digital oscillators controlled by 64 pairs of ramp generators, respectively. This basic program, to be described in connection with FIG. 11, for the synthesizer in the illustrative embodiment consumes approximately 2 microseconds during each 32-step cyclic operation thereof. Sixteen repetitions of that basic program are executed each 32 microseconds with different sets of data for calculating all 64 oscillators and thereby fixing the sampling period for 32 kHz operation. Eight repetitions of the 32-microsecond sequence are executed about every 256 microseconds to calculate all 128 ramps, FIG. 3 is a simplified functional diagram depicting operation of the synthesizer 16 in FIG. 1 as digital oscillator circuits controlled by computer 13. An important element in this operation is a set of ramp generators 46, each of which produces a sequence of digitally coded characters having increasing (or decreasing) values. Each generator advantageously comprises a set of dedicated locations in a random access memory for storing the aforementioned current, increment, and final values of the ramp. On each synthesizer basic program recurrence, a different one of the ramps, there being 128 such ramps in the illustrative embodiment, is incremented using a microprocessor-type arithmetic/logic unit in the synthesizer to add the increment value, which may be positive or negative, of the ramp generator to its current value. The resulting sum is compared to the aformentioned final value of the ramp. If that final value has not yet been attained, the sum is stored in the random access memory as the new current value by overwriting the old current value. However, if the comparison, also performed in the arithmetic/logic unit, shows that the final value has been equalled or passed, the generation of an interrupt signal to the computer 13 is initiated as a request for new data for the ramp. In addition, the synthesizer logic determines whether to store, as the new current value of the ramp for further synthesizing the sum or the exact initially-specified final value of the ramp.

Still in FIG. 3, the synthesizer includes additional digital oscillator circuits which are controlled by outputs from the various ramp generators. In the illustrative embodiment considered herein one set of digital oscillator hardware is advantageously employed and multiplexed 64 ways to realize 64 independent oscillators. That many oscillators are capable of synthesizing in score-real-time a sound as complex as that produced by a 10- to 15-piece orchestra. There are, of course, other ways to implement these oscillators; and one such way would be, e.g., by employing large-scale integration to build 64 separate oscillators. In the illustrative embodiment using a multiplexed digital oscillator, a wavetable memory 23 is provided for storing digitally coded samples of a cycle of a fundamental wave for the actual effect which is to be produced by the synthesizer. This fundamental wave is typically a sine wave, or a sum of sine waves harmonically related, for the synthesis by the present invention of most conventional musical instruments. Sample values for the wave are supplied from the computer 13 at the start of a conventional-instrument music synthesis operation. If the production of special audible effects should be involved in the synthesis, a different fundamental waveform cycle could be employed and loaded into the wavetable, or a part thereof, shortly before the time at which the special effect synthesis must take place.

The wavetable memory 23 is addressed at its sequential locations to provide an X-input to a multiplier 47. Each digital oscillator is assigned one ramp generator to provide digitally coded address values which are coupled through a multiconductor bus and a circuit 48, which in FIG. 3 is schematically represented as a coincidence circuit. In FIG. 3 and other figures, a multiconductor bus is usually indicated by a short diagonal line across a conductor and an adjacent number indicating the number of conductors. The ramp steps are periodically calculated for incrementing the ramp, and the slope of the resulting ramp is fixed by the increment value used in the 4-value set defining the ramp. Each frequency ramp has its various successive current values accumulated, modulo the maximum address in memory 23, to provide a phass sawtooth signal with the repetition interval being a function of the then current value, or values, of the frequency ramp. Values of that phase sawtooth signal are the memory 23 address signals, and a full sawtooth interval represents a phase sweep of 0 degrees to 360 degrees of the basic wave in memory 23. Hence, the frequency ramp generator affects the instantaneous rate of phase sweep and thereby is said to fix the frequency of the digital oscillator involved.

Each digital oscillator also has assigned for its further control an additional ramp generator to provide multiplier coefficients to the Y-input of the multiplier 47 for determining respective amplitude modifications of the wavetable sample amplitudes supplied to the X-input of the multiplier. Those amplitude modifications are appropriate for reproducing the piecewise linear segment amplitudes of the not envelope, considered in FIG. 2, for which the ramp is assigned. Thus, the ramp initial current value, increment value, and final value are assigned by the computer 13 to cause the sequence of ramp output character values to approximate in small steps the slope of the mentioned segment.

For any given one of the digital oscillators, the frequency and amplitude (multiplier coefficient) ramps may terminate either at different times or at the same time. Accordingly, these ramps are treated as separate units in the synthesizer process even though they are assigned to work with the same digital oscillator.

In each complete execution of the illustrative basis synthesizer program it will be shown that a different set A-D of four of the 64 oscillators, and a different one of the 128 ramp generators are calculated, i.e., each oscillator is calculated eight times as often as each ramp.

The output of multiplier 47 for any given oscillator calculation comprises a digitally coded sample of the tone specified by the frequency-controlling ramp and wavetable. That tone sample is coupled through an adder 49 wherein it is advantageously combined with either a sample from a prior oscillator calculation of a different one of the 64 oscillators or the sum of samples of plural prior oscillator calculations or zero. The sum output of the adder 49 is stored in a switch memory 50 in one of fifteen registers in that memory which are selected by address signals specified by computer 13. Another register in the switch memory 50 stores the zero value, just mentioned. The remaining ones of the registers store the results of other oscillator calculations.

Outputs from the switch memory 50 are produced by addresses supplied by computer 13 and these outputs fall into one of four functional classes indicated by memory output paths in FIG. 3. One such output is provided on a bus 51 representing a 24-bit parallel output to the digital-to-analog converters 15 of FIG. 1. Another output is provided on a 24-bit functional circuit 52 to a second input of the adder 49. A third type of output from the switch memory 50 is provided on a functional circuit 53 by way of an option register, to be described, as a different source, selectable by a functional switch 56, for the X-input to the multiplier 47. This alternate X-input provides a substitute wave sample input for certain purposes, e.g., amplitude scaling or modulation. A fourth type of output from the switch memory 50 is provided on a functional circuit 57 by way of an FM-register, to be described. This output is applicable as an alternate input, selectable by a functional switch 58, as a substitute Y-input multiplier coefficient for the multiplier 47 in certain cases. For example, the functional circuit 57 can also be coupled through the coincidence circuit 48 to modify the oscillator frequency ramp output address sequence to the wavetable memory 23. This latter type of operation produces frequency modulation of the oscillator. A further functional circuit 54 between the circuit 53 and switch 58 is useful, in a way to be described, for coupling option register data from memory 50 to the multiplier Y-input. Although the four outputs of memory 50 are for convenience shown as separate circuits, they all are advantageously branches from a common memory output port.

It will be apparent to those skilled in the art that, in lieu of ramp control, the digital oscillator frequency is alternatively controllable by other means. For example, a single counter can be driven at a constant rate and different sets of selectable logic used to select different sets of the count outputs for application as addresses to memory 23. However, this permits much less flexibility, is more expensive to implement, and limits the synthesizer's capabilities.

Figure 4B:
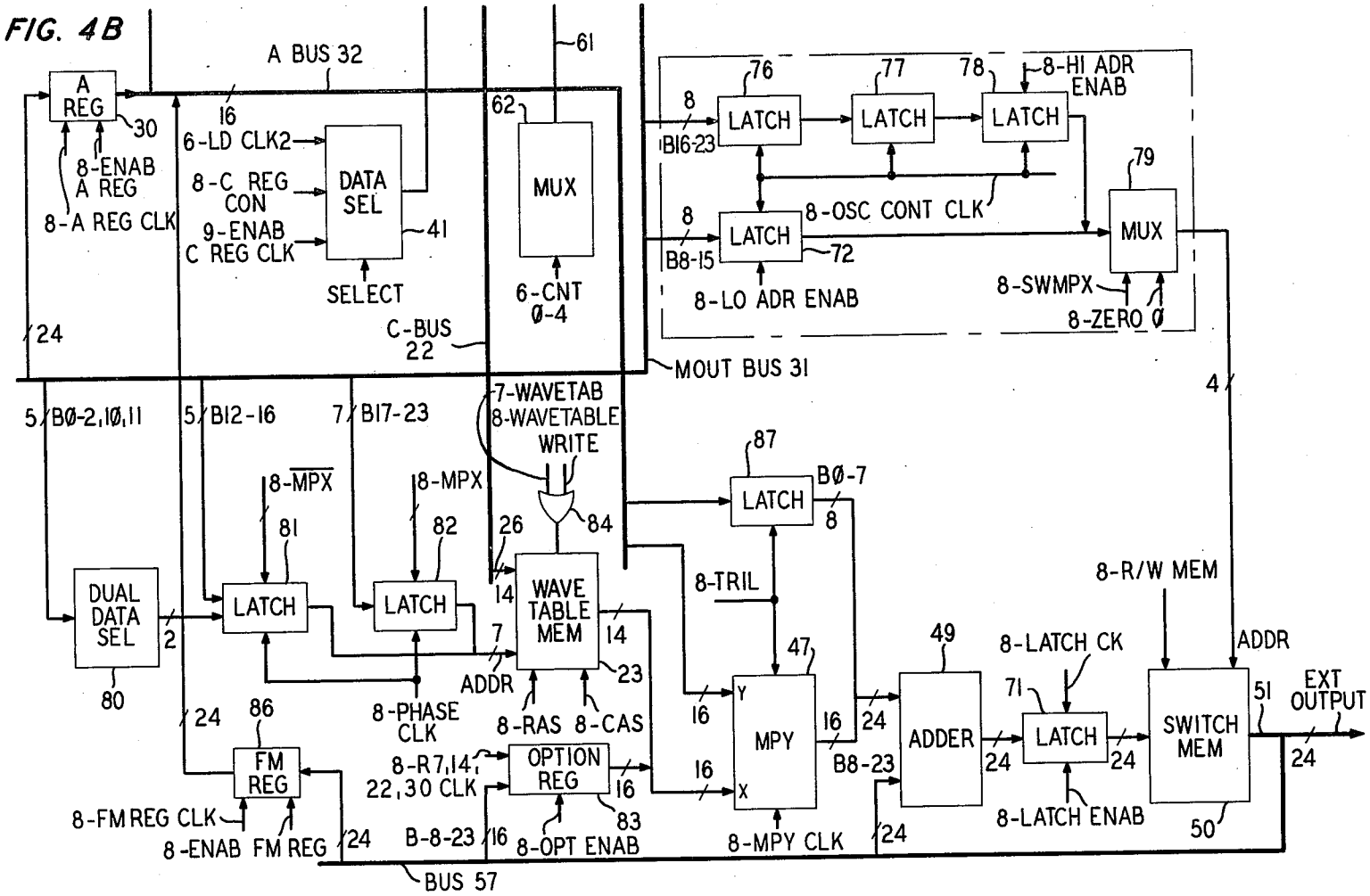

FIGS. 4A and 4B when placed as shown in FIG. 4C illustrate the data paths for one embodiment of the synthesizer 16. The combined figures are hereinafter usually simply designated FIG. 4. Control signals for the circuits of FIG. 4, and other figures, include a numerical prefix indicating the figure of origin when that figure is different from the figure in which the circuit of use appears. Signals coming from the computer 13 to the synthesizer via FBϕ-15 (part of bus 19) are strobed into a 16-bit, three-state latch register 20 and a similar 8-bit latch register 21 by a 7-DOUT function control signal. Such latch registers are characterized by outputs that have a selectable high impedance output, in effect disabled, or a low impedance output having a binary ONE or ZERO signal state. The latch 21 contains only the high-order eight bits B8-15 of any incoming data word, while the latch 20 contains all sixteen bits Bϕ-15 of such word. Outputs from these latch registers are coupled to a C-bus 22 in response to the 8-COMP CENAB control signal. The C-bus is a 24-bit bus, and the sixteen bits from the latch register 20 are applied to the bus in bit positions 8–23, while the signals from the latch register 21 are applied to the C-bus in bit positions ϕ–7 thereof.

From the C-bus the bits of the data are coupled to different destinations in the synthesizer. One of these is the wavetable memory 23 to which fourteen bits from bit positions 1ϕ–23 of the C-bus are applied through a 14-bit latch buffered bus 26 as addresses. The full 24 bits of the C-bus are also applied to an exponential shift register 27 which will be further described. Finally the full 24 of the C-bus are also applied to the 24-bit data input connections to a random access memory 28.

That memory 28 has two write enable signals in order to accommodate one particular computer 13 which operates on a 32-bit word having 16-bit high-order and low-order bytes. Those enable signals are 8-WRITE HOB and 8-WRITE LOB, reference being to those two bytes, for selecting different bit groups from the 24-bit data input bus. One or the other of these two enabling signals is selected depending upon whether the address specified for a memory write operation by the computer 13 is an even address or an odd address. For odd addresses, the 8-WRITE LOB signal is applied to the memory 28 so that it can write into the least significant byte portions of the addressed word of memory 24 data provided in the eight high-order bits of the input data bus, i.e., the bits contained in the latch register 21. On the other hand, upon reception of an even address the 8-WRITE HOB enable signal is selected and memory 24 then receives data from the sixteen low-order bits of the data input bus to be written into the most significant byte portion of the memory location. Alternatively, of course, both of the aforementioned write enable signals are supplied to write all 24 bits of the data input when a full 24 bits of input information are available. The contents of the random access memory 28 are divided into sectors as indicated in FIGS. 5A–5D, and the latter figures will now be described to aid in understanding the rest of FIG. 4.

Figure 5A:
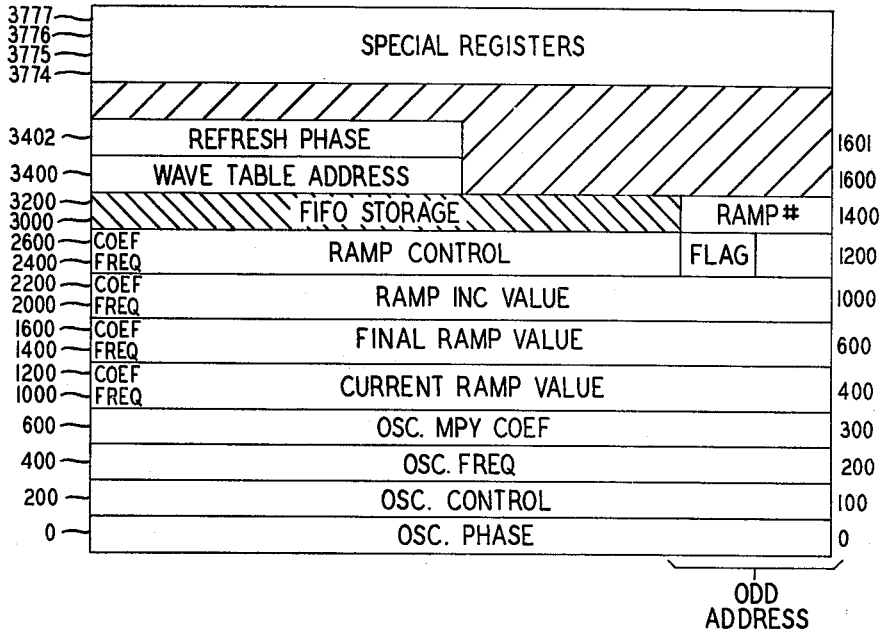
FIGS. 5A–5D illustrate memory organization features for memory in FIGS. 4A and 4B.

FIG. 5A is a map of the contents of memory 28 illustrating the physical addresses applied to the different sectors of the memory. This memory in the illustrative embodiment has a capacity of about 1000 24-bit words. Low-order bits accessed by odd addresses from computer 13 are at the right-hand side in FIG. 5A. Address representatives at the left in that figure are octal base addresses (two per location) received from computer 13, and representations at the right are addresses (one per location) used by synthesizer 16.

Starting with the sector having the lowest starting address of those indicated along with the lefthand side, it comprises 64 word locations, designated OSC PHASE, for storing digitally coded words indicating the present value, i.e., wavetable memory 23 address, of a digital oscillator phase. Each OSC PHASE word is recurrently altered by a corresponding OSC FREQ word resulting from a frequency ramp computation. The $2^{24}$ possible states of OSC PHASE words represent phases of 0 degrees through 360 degrees. The number of times per second that the phase goes through 360 degrees is the frequency of oscillation.

In the next sector OSC CONTROL of sixty-four 24-bit words there is stored one word per digital oscillator and containing control fields for administering the operation of the corresponding oscillator. The contents of these fields are initially supplied by the computer 13 for use during the persistence of a musical note.

Figure 5B:
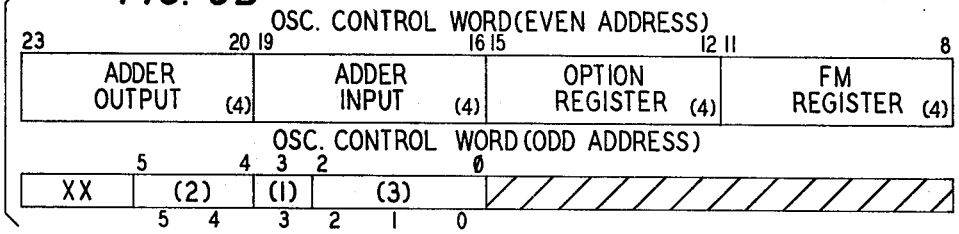

A diagram for the two control word bytes of one typical oscillator is shown in FIG. 5B superimposed on a full 32-bit word span as used by computer 13. Bit position numbers in RAM 28 and on C-bus 22 are shown adjacent to each word. The control word addressed by an even address from computer 13 includes four fields of four bits each, and each field comprises a different address of the switch memory 50 to be described. The names of the fields suggest particular functions of FIG. 3 for one of the possible time-shared oscillators. One of the four words, FM REGISTER, contains an address where there will be stored data, for the corresponding oscillator, to be coupled to the FM-register which will be described. A second field, OPTION REGISTER, contains a switch memory address where there will be found data, for the corresponding oscillator, to be coupled to the option register to be described. The remaining two fields, ADDER INPUT and ADDER OUTPUT, contain switch memory addresses for obtaining input data, usually relating to other oscillators than the one to which the control word is assigned, for bus 52 to the adder 49 and receiving output data from that adder, respectively, as will also be described.

In the other control word byte of FIG. 5B, i.e., the word accessed by the odd address, only six bits of the word are utilized. Three of these bits ($\phi$-2) define different configurations in which the aforementioned wavetable memory 23 can be employed as will be described. Memory 23 can be used as a single 16,384-word memory, or as two 8,192-word memories, or as four 4,096-word memories. When positioned into smaller tables, these bits also select which table is to be used. An additional 1-bit word of this latter control word is used to define one or the other of two possible X-inputs to multiplier 47. Thus, the X-input may be taken either from the wavetable output or from the output of the option register. Finally, a 2-bit field defines one of three possible Y-inputs to the same multiplier 47. These comprise the amplitude ramp function (via an A-register to be described) from a different sector of the random access memory 28, the FM-register, or the option register (supplied by clocking the FM-register when option register data is supplied from memory 50).

Two additional sectors in the memory map of FIG. 5A include an OSC FREQ sector and an OSC MPY COEF sector where there are stored oscillator frequency-defining data and oscillator signal amplitude-defining data, both provided by ramp function generators.

Figure 5C:
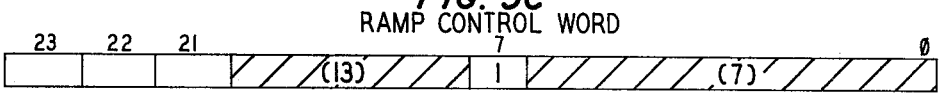
Figure 9:
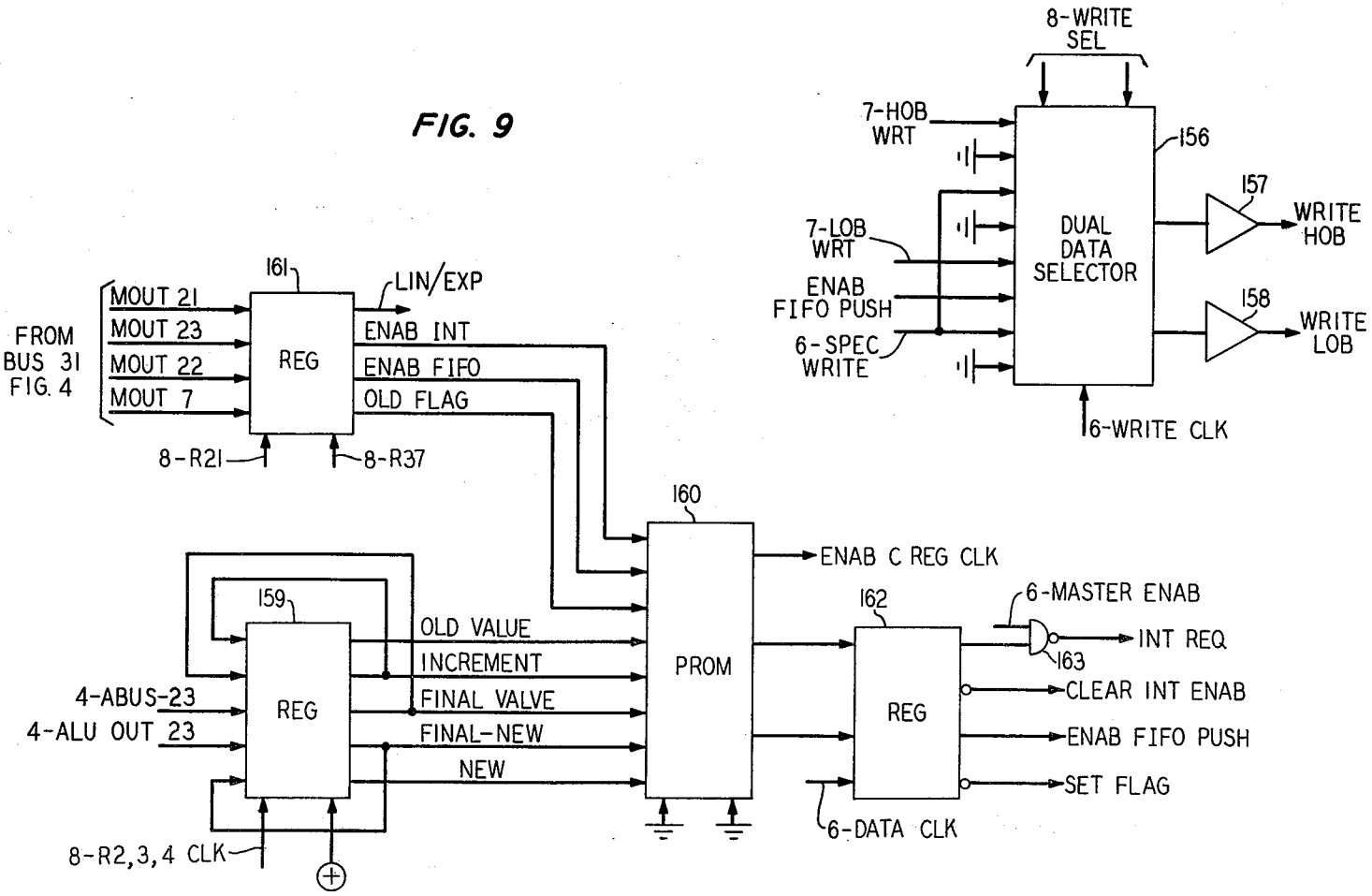
FIG. 9 is a diagram of ramp overflow evaluating logic useful in the synthesizer of FIG. 4.

Four additional sectors provide storage for four words for each of 128 ramps. For each ramp, either amplitude or frequency control, there is a current value, a final value, an increment value, and a ramp control word. The fields of a typical ramp control word in memory 28 are illustrated in FIG. 5C and reveal that only four bits of such a word are actually utilized for the illustrative embodiment. The circuits for utilization are shown in FIG. 9. One of these bits, in bit position 7, is a flag which is set to the state of a CNT$\phi$ signal by synthesizer 16 from bit 7 of a buffer 43 in FIG. 4A when the ramp function has been completed; and it is cleared to the binary ZERO state by computer 13 when data for a new ramp function is written after an interrupt has been received. This flag bit is also indicated in FIG. 5A. Buffer 43 in FIG. 4A is used for two different functions. Bits $\phi$-6 (input CNT5-11) supply the 7-bit ramp number when an entry is made into the FIFO storage area. Bit 7 (input CNT$\phi$) supplies the ramp flag when needed. The CNT$\phi$ signal is thus applied to bit 7 of the control word so that when buffer 43 is used for an FIFO data source bit 7=0. When buffer 43 is used as a source for the ramp flag, bit 7=1. Since bits $\phi$-6 are not important when the ramp flag is of interest, it does not matter that these are also modified when the ramp reaches its final value.

The bit in bit position 21 in FIG. 5C determines by its binary signal state whether the final ramp output that is used will be in the linear-coding form or in the exponential form, i.e., the bit determines the selection of a data input source for writing that final value into memory 28. Bit 22 is an enable FIFO bit which indicates by its binary signal state the action which should be taken with respect to a ramp-complete FIFO queueing register. If the bit is a binary ZERO, no FIFO action will be taken. If the bit is a binary ONE and the flag bit is a binary ZERO, the number of this ramp can be entered in the FIFO upon completion of the ramp function. Bit 23 is an enable interrupt bit which is in a binary ZERO state when no interrupt action can be taken for this ramp. For example, in the FIG. 2 case where the frequency for a note is constant for the segment being synthesized, there is no need to generate an interrupt to indicate a ramp completion. When bit 23 is in the binary ONE state, and when a master interrupt bit, to be described, is also in the binary ONE state, and the flag bit is in the binary ZERO state, the synthesizer will request a computer interrupt upon completion of the ramp function.

Returning to FIG. 5A, the next sector of the memory map contains storage for the aforementioned FIFO queueing registers. In the low-order bit section of this memory space are stored the numbers of the respective ramps which have finished their particular ramp functions and are awaiting a new data assignment.

A further word in the memory map is one utilized for wavetable address. The computer intializes this address to the value of the desired wavetable memory 23 address when data is to be loaded into the memory. Thereafter, when the computer calls for a write with the address 3774, the synthesizer recognizes it as a special operation and uses RAM 28 address location 3400 data as the address for memory 23. The memory 28 read-out containing the address for accessing the wavetable memory 23, is also automatically incremented (at gate 38 in FIG. 4) and written back into memory 28 location 3400. In a similar fashion the next sector, at address 3402, in RAM 28 contains the next address in the wavetable memory to be used by program when the refresh phase, to be discussed, of the program is being executed.

Figure 5D:
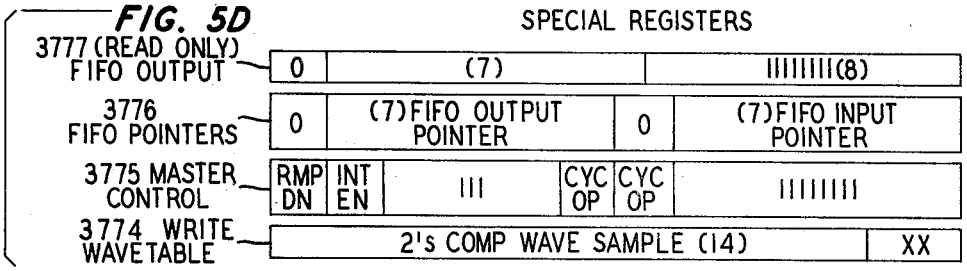

Also included in the memory 28 are four special registers at addresses 3774–3777, the fields of which are illustrated in FIG. 5D as respective bytes of the computer 32-bit word. The data control and storage locations at addresses 3774–3777 are not physically located in RAM 28. Several separate storage devices, to be mentioned, are used for this data, and the locations 3774–3777 in the RAM 28 are actually unused. Special circuits, further considered in connection with FIG. 7, recognize when the computer is accessing these locations; and these circuits disable RAM 28 and enable the appropriate separate device for loading or reading by the computer.

In FIG. 5D, the FIFO OUTPUT register at the read-only odd address location 3777 is actually an FIFO output pointer counter 67 in FIG. 4. That is, when synthesizer circuits of the type in FIG. 7 recognize this address, they use the contents of the FIFO output pointer counter 67, to address memory 28 FIFO STORAGE, and send to computer 13 the ramp mumber stored there, i.e., the ramp function to be serviced next.

FIFO POINTERS are indicated by the special register at location 3776. Two 7-bit bytes indicated at this even address are the pointers maintained by the synthesizer in counters 67 and 68 for use as RAM 28 addresses when entering ramp numbers into FIFO STORAGE and when retrieving such numbers when the computer asks for the next ramp needing service. The uses are automatic relative to the computer. On recognizing the address 3776 from computer 13, synthesizer 16 selects the outputs of counters 67 and 68 and couples them through drivers 69 and 70 to computer 13.

A master control word register is indicated at odd location 3775 and actually comprises flip-flops 113 and 123 to be described in connection with FIG. 7. The two most significant bits are written into those flip-flops by the computer 13 to deal with ramp terminations. Other bits are used to specify a certain mode of synthesizer operation for maintenance. The most significant bit of this word comprises a master ramp-done flag bit RMP DN which is set to the binary ONE state by the synthesizer if any enabled ramp has completed its function, and the bit is set to the ZERO state when the FIFO queue has been cleared. That RMP DN bit is an easily tested flag to allow quick determination of whether or not the FIFO queue is empty. The next most significant bit is an interrupt enable bit INT EN which is set by computer 13 to enable the synthesizer to generate an interrupt.

The final special register is at even location 3774. It is another "dummy" location used during synthesizer initialization when writing memory 23. When the synthesizer recognizes this address, it loads the 2's complement representation of a wave sample from the latch registers 20 and 21 into the wavetable memory 23. This is achieved by recognizing the address 3774 using read-only memory logic to be discussed in connection with FIG. 7 to generate the WAVETAB signal. This signal causes a modified refresh cycle in that its altered state at one input of RAM address multiplexer 62 causes the wavetable address to be selected (rather than the refresh phase address). This provides the address to MEM 23. Data from the computer 13 is asserted on the C-bus during program times R1 and R2. The write signal to MEM 23 is generated by ORing in gate 84 the WAVETAB and WAVETABLE WRITE (a ROM-generated signal) as shown on FIG. 4B.

Referring again to FIG. 4, the various arithmetic and logic operations involved in generating the aforementioned ramp functions and involved in certain other functions are performed by an arithmetic/logic unit 29. This unit need perform only four different operations in connection with the illustrative embodiment of the invention here under consideration, and the operation selected at any particular time in the program is determined by the control signals 8-ALU Sϕ and 8-ALU S1. An A-input to the unit 29 is provided from an A-register 30 which is loaded, upon occurrence of an 8-AREG CLK signal, from the output of the memory 28 by way of a memory output (MOUT) bus 31. The output from the A-register 30 is applied in response to an 8-ENAB AREG signal to an A-bus 32 and to the A-input of the arithmetic/logic unit 29.

The B-input to the unit 29 is supplied from the output of the same unit by way of a 24-bit bus 33 and a B-register 36 upon occurrence of an 8-BREG CLK signal. The output of the B-register is permanently enabled and is coupled through a 24-bit bus 37 to the unit 29. However, bit BIN1ϕ in that bus is separately coupled through an OR gate 38 which alternatively applies a program signal 8-R37 after coupling through an inverter 39. It will subsequently be seen that this control of the tenth bit is used to increment an address used to refresh, or write anew, the contents of the wavetable memory 23 word by word on different program cycles.

Output from the arithmetic/logic unit 29 is clocked into a C-register 40 upon occurrence of a clock signal provided by a data selector 41 when that selector is strobed by the 6-LD CLK 2 clock signal. All of the registers A–C are three-state latch registers. The selector 41 responds to input selection signals 8-SELECT to pick one or the other of two control signals 9-ENAB CREG CLK or 8-CREG CON. Selector output is coupled through an inverter 42 to a clocking input of the C-register. An 8-CREG ENAB function clock gives the 24-bit C-register output access to the C-bus and hence to the data inputs of memory 28 and the exponentiating shift register 27.

A buffer register 43 contains the number of a ramp currently being calculated, i.e., bits ϕ and 5-11 from a program counter to be described. When a ramp has reached its final value an entry is enabled in the FIFO registers of FIG. 5A. Upon occurrence of an 8-FIFO CNT ENAB control signal, the CNT5-11 contents of the register 43 are coupled out as bits ϕ-7 of the C-bus 22. That number is then optionally written if ramp terminated, into a location in memory 28 pointed by an FIFO input pointer counter 68 in FIG. 4A. The decision whether or not to write is made by logic in FIG. 9 to be described. The flag bit of the ramp control word (FIG. 5C) is set during the same program cycle at step R27 by the CNTϕ signal via buffer 43 as already described. Also the SET FLAG signal from register 162 in FIG. 9 is applied to flip-flop 103 in FIG. 6 to be available for advising computer 13 of readiness for new data. The FIFO input pointer is also incremented at this time by the 9-ENAB FIFO PUSH signal from register 162. When computer 13 needs to send new data to a ramp, it causes logic in FIG. 7 to generate an FIFO ACCESS control signal. That causes the FIFO output pointer in counter 67 to supply the memory 28 address during program time R5 when the computer has access to that memory. That counter is also incremented at this time by the 7-INC FIFO OUT PNT control signal from FIG. 7.

Still in FIG. 4, some functions involved in the operation of the synthesizer 16 are more realistic in an acoustic sense if when they change they do so in an exponential rather than in a linear fashion. To this end the current ramp value of any given ramp generator, i.e., the value which is used by the digital oscillator, appears as a quantity at the output of the arithmetic/logic unit 29 and is loaded into the B-register 36 to be available there during a step R3 of the basic synthesizer program of FIG. 11. Output bits BIN1ϕ-18 of the B-register 36 are utilized to address an exponent read-only memory 59 for reading out, when that ROM output is enabled by the 8-EXP ROM ENAB control signal, a value which is the exponential form of the same value used to address the memory.

Such 8-bit output of the ROM 59 appears on the C-bus 22 in bit positions 16–23 thereof and is loaded into the exponentiating shift register 27. The output bits 19–22 of the B-register 36 are used after operation thereon by shift logic 60, which will be considered in more detail in connection with FIG. 10, as an exponent value to control shifting of the value just loaded into the shift register 27. Upon completion of the indicated extent of shifting, contents of the shift register 27 are in response to the 8-EXP SR ENAB control signal coupled out to the C-bus 22 as the aforementioned ramp current value in exponential form.

At step R34 in the basic synthesizer program the same ramp current value taken from B-register 36 is read from the current value location for the ramp in the memory 28 and moved to the C-register 40 so that at the program step R37 both the linearly coded value in the C-register and the exponentially coded value in the shift register 27 are available for selectable use in the digital oscillator. Selection is effected by ROM C logic, to be described, as a function of the state of the bit 21, MOUT 21, in FIG. 5C. The selected value is then written into the oscillator OSC MPY COEF word in memory 28 or into the OSC FREQ word in memory 28 as is warranted for the assignment of the particular ramp for which the current value was obtained.

Addresses for the memory 28 in FIG. 4 are provided on a 10-bit bus 61 from a multiplexer 62 in FIG. 4B which draws data inputs from eight different locations in different parts of the synthesizer 16 and from the computer 13. The selection effected by the multiplexer 62 is controlled by five low-order bits 6-CNTϕ-4 of a program counter via ROM B logic 130 in FIG. 8.

Output bits from memory 28 in FIG. 4 are designated MOUTϕ-23 and appear on the bus 31 as well as being loaded into three-state latch registers 63 and 66 in response to the program signal 8-R5. The eight low-order bits ϕ-7 are thus loaded into the latch register 66 while the sixteen high-order bits are loaded into the latch register 63. Output signals from one or the other of the latter registers are selected for transmission to the computer 13, on a T-bus including bits TBϕ-15, by the control signals 7-ENAB RAM HOB or 7-ENAB RAM LOB. Thus, contents of any location of memory 28 can be transmitted for manipulation, e.g., FIFO data or testing, by computer 13.

Also available on the same data bus to the computer 13 are FIFO pointer words. Control signals, 7-INC FIFO OUT PNT and 9-ENAB FIFO PUSH drive pointer counters 67 and 68, respectively. Those counters are cleared by the 7-CLR PNT control signal. Counter output in each case is coupled to the T-bus by way of a 7-bit circuit and one of the drivers 69 or 70 when selected by the 7-ENAB CNT control signal. Output T-bus bits to the computer in bit positions ϕ-6 are used for the input pointer and bus bits 8–14 are used for the output pointer.

The switch memory 50 in FIG. 4B includes, illustratively, sixteen 24-bit registers as already indicated. Data input to the switch memory is provided from a three-state latch register 71; and data output is coupled to a plurality of different locations, including the synthesizer output on the 24-bit bus 51 to the digital-to-analog converters 15. Addresses for the switch memory 51 are supplied from the oscillator control words in the memory 28 for each oscillator as described in connection with FIG. 5B. Such addresses are coupled by way of three-state latch registers 72 and 76–78 and through a 4-bit wide multiplexer 79. All of the registers 72 and 76–78 are loaded on the 8-OSC CONT CLK control signal if any signal is then present at the bit-parallel data inputs to the respective registers. Thus, the eight memory output bits MOUT8–15 from the bus 31 are loaded into the latch 72, and the eight higher-order bits MOUT16–23 are loaded into the register 76. Similarly, on successive occurrences of the same clock control signal, after the aforementioned loading, the contents of latch 76 are moved successively to the latches 77 and 78. Outputs of registers 72 and 78 are enabled by 8-LO ADDRENAB and 8-HI ADDRENAB signals, respectively. Corresponding outputs of latches 72 and 78 are advantageously strapped together, and the four low-order output bits are applied to one 4-bit input of the multiplexer 79 while the four high-order bits are applied to a second input of that multiplexer. One or the other of those two sets of input bits is selected by the 8-SWMPX signal. In the absence of any specific address in three-state address latches 72 and 78 their outputs are automatically all ONEs so that the multiplexer calls for the address octal 17. An 8-ZERO ϕ control signal strobes the multiplexer to respond to the selection, and an 8-R/W MEM signal determines whether to read or write the memory. Thus, any of the 4-bit oscillator control word fields is selectable for application to address inputs of the switch memory 50.

The wavetable memory 23 receives input data by way of the bus 26 from the most significant 14 bits of the computer-coupling latch registers 20. Addresses for the memory 23 are provided by MOUTϕ-2, and 1ϕ-23 signals on the bus 31. Bits ϕ-2 in an OSC CONTROL word and bits 1ϕ and 11 of an OSC PHASE word in those signals are utilized in dual data selection logic 80 which selects the configuration of the wavetable as previously mentioned in connection with FIG. 5B. Those bits determine a selectable one of four different sets of states for two output bits. The latter two bits are combined, as least significant bits, with bits MOUT1-

2–16 to make up a 7-bit address which is stored in a three-state latch register 81 while the bits 17–23 are stored in a further such register 82. Both such registers are clocked for storing by the 8-PHASE CLK signal. One or the other of the two registers 81 or 82 is enabled by 8-$\overline{\text{MPX}}$ or 8-MPX to provide output in the form of a 7-bit address to the memory 23.

Two of the aforementioned 7-bit addresses are utilized for each access to the memory 23. Strobe signals 8-RAS and 8-CAS strobe those addresses, respectively, into internal latches in the memory; and the 14-bit total address is used to achieve the desired access. When used as a 16K-word table, each memory location is accessed sequentially. When configured as two 8K-word tables, alternate words are accessed sequentially, even addresses for one table and odd addresses for another. Similarly, when configured as 4K-word tables every fourth word in any of the four different sequences is accessed sequentially. Read/write control is effected by the 7-WAVETAB and 8-WAVETABLE WRITE signals applied through an OR gate 84.

As briefly indicated in regard to FIG. 3, an FM-register 86 couples the output of memory 50 to A-bus 32. The register is loaded on the 8-FM REG CLK signal, and its output is enabled on the 8-ENAB FM REG signal. This permits a memory 50 word to be coupled thru ALU 29 and RAM 28 for modifying a memory 23 address to effect frequency modulation.

The multiplier 47 has been hereinbefore described to some extent in connection with FIG. 3. This multiplier is advantageously a TRW, Inc., MPY 16AJ multiplier. 8-MPY CLK signals schematically represent X, Y, L, and M clock signals for the multiplier. X and Y clocks cause the coupling of respective input signals to corresponding internal input registers of the multiplier. Similarly, the L and M clocks cause the coupling of least significant and most significant parts, respectively, of the product to corresponding internal output registers of the multiplier. Although that multiplier has 16-bit X- and Y-inputs and a 16-bit output, it has a further internal capability for multiplexing the least signficant half of its 31-bit total product output to the Y-input pins of the multiplier in order to conserve pins. Since in FIG. 4 a 24-bit input is used for adder 49, a three-state latch 87 is provided to couple the eight least significant product output bits from the Y-input to the adder input. The 8-TRIL signal enables the mentioned multiplexing capability, and it also clocks the input to the permanently-output-enabled latch 87 at multiplier output times and disables the latch at other times to isolate the adder input from the A-bus 32. The latter adder receives an additional input directly from the SOUT bus 57 which couples signals from the output of the switch memory 50.

At the X-input to multiplier 47 there are received either 14-bit pulse-coded characters from the memory 23 or 16-bit pulse-coded characters from an option register 83. The latter register is loaded on various program clocks R7, 14, 22, 30 CLK, and its output is enabled on 8-OPT ENAB. The Y-input of multiplier 47 is supplied with 16-bit words by way of the A-bus 32 from either the A-register 30 or an FM-register 86. The selection of the particular input choices to be used in accordance with the FIG. 11 timing diagram is made by ROM E logic, to be described, in cooperation with memory 28 bits MOUT3–5 in FIG. 5B.

The contents of either A-register 30 or FM-register 86 can also be applied through the arithmetic/logic unit 29 to modify an OSC PHASE word and then be coupled through the C-register 40, as data to memory 28. The modified OSC PHASE value is later used to address memory 23 and thereby effect oscillation by changing the sample appearing at the X-input to the multiplier. Output of adder 49 is loaded into a register 71 on the 8-LATCH CK signal and transferred to memory 50 on the 8-LATCH ENAB signal.

It will be appreciated by those skilled in the art that auxiliary functions can be conveniently combined with those of the FIG. 4 synthesizer. To this end supplemental address information for memory 50 is supplied, e.g., through an additional three-state latch register (not shown), at an input to the multiplexer 79. Similarly data input is supplied by a circuit (not shown) at the same memory input port to which latch 71 is connected. That auxiliary function receives data from the memory 50 output port. Otherwise, computer 13 advantageously controls such auxiliary function in a manner appropriate to its character, e.g., a digital filter or a digital reverberator.

Figure 6:
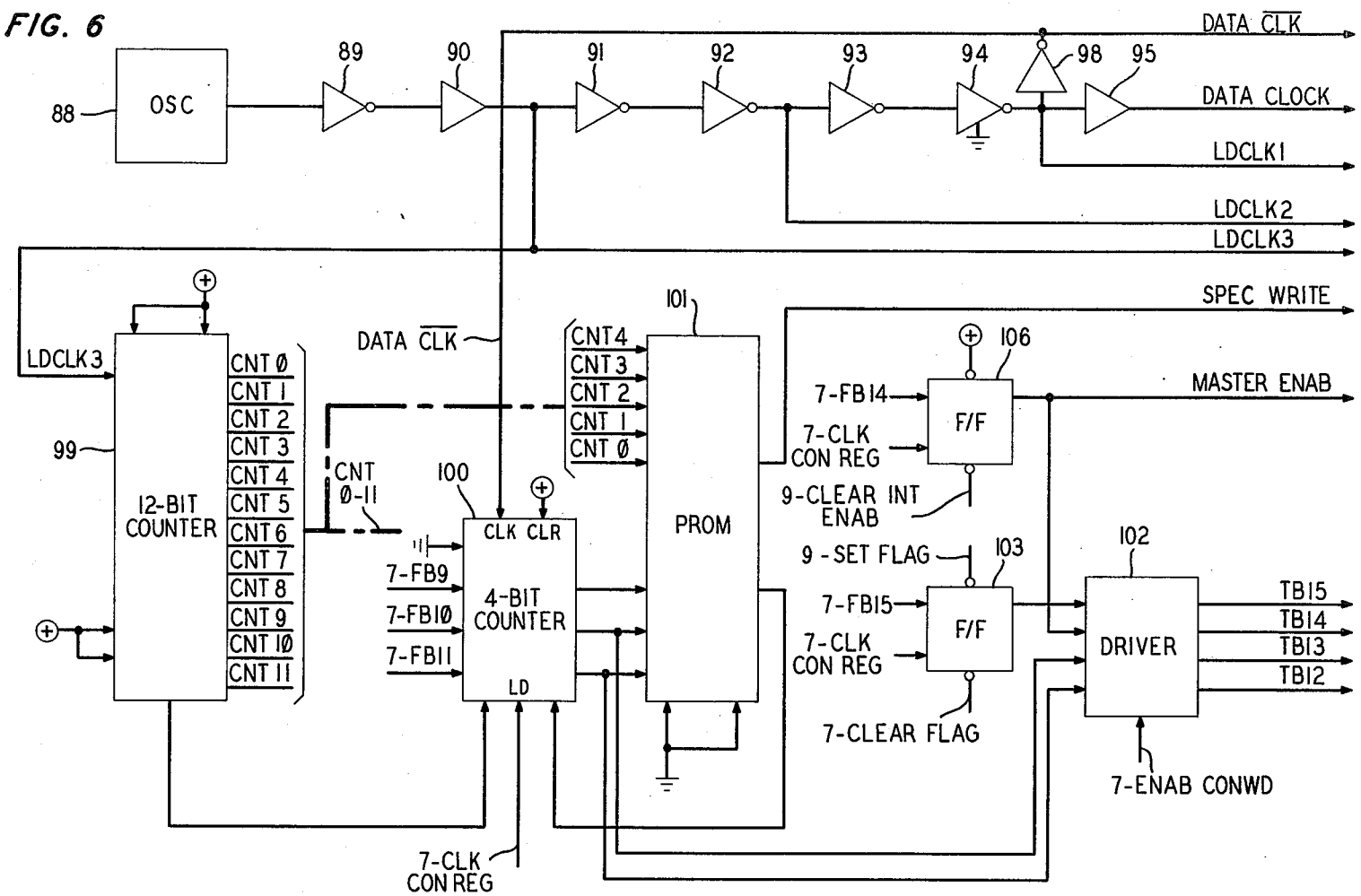
FIG. 6 is a schematic diagram of periodic clock signal generating and program counting arrangements for controlling the synthesizer.

In FIG. 6 are shown circuits for providing periodic clock signals to be used throughout the synthesizer 16 and particularly such signals to be used for operating counters which drive other circuits for producing the various function clocks, i.e., control signals, utilized throughout the synthesizer. Thus, an oscillator 88, which is illustratively operated at 16.38 MHz, provides an output through a chain of buffer circuits 89–95, such as the Texas Instruments buffers SN74-S240 (inverting) and SN74-S241 (noninverting). Of those, the buffers 89 and 91–94 produce inversions. Signals of different delays and appropriate phase are tapped off between different sets of buffers to provide different clocks. The output of buffer 90 is LDCLK3. A further delayed clock LDCLK2 is provided from the output of the buffer 92, and the next buffer 93 provides $\overline{\text{LDCLK1}}$. Output from buffer 94 comprises the LDCLK1 signal which is inverted by a buffer 98 to produce a DATA $\overline{\text{CLK}}$ signal.

The LDCLK3 signal is utilized to clock a 12-bit counter 99 which has its load and clear input control signals permanently disabled. Bit-parallel outputs from the respective stages of the counter 99 comprise the counter signals CNTϕ-11. CNTϕ-4 are utilized to operate different read-only memories in the synthesizer and to provide control inputs to various other circuits for sequencing the 32 steps of the basic program. CNT4-8 cycle through the 32-step program sixteen times to count oscillators for addressing RAM 28 oscillator words to complete one sample calculation for all 64 oscillators. That calculation is repeated at a 32 kHz rate. CNT5-11 (7bits) are used to address RAM 28 ramp words to calculate the 128 ramp functions at a 4 kHz rate. In addition, the carry output of the most significant bit stage of the counter 99 is applied as one enabling input to a 4-bit presettable counter 100. This counter is loaded from bits 7-FB9-11 of a bus extending through a bidirectional register (to be described) from the computer 13 upon occurrence of the 7-CLK CON REG signal. The aforementioned DATA $\overline{\text{CLK}}$ signal drives the counter 100 from its preset condition, and outputs are derived from three bit outputs of the counter for application as a partial address to a programmable read-only memory (PROM) 101 in response to a coincidence of the carry bit from counter 99 and an output bit from the memory 101. Five additional address input bits are provided to the PROM 101 in the form of the program counter bits CNTϕ4 so that the total of eight address bits to the PROM 101 are capable of defining the output bits at 256 different times determined in part by the program counter 99 bits.

One output of PROM 101 is that previously mentioned to enable partially the operation of counter 100. Another output is SPEC WRITE signal used in conjunction with read-only memory logic in FIG. 8 for exercising single-stepping control of writing operations into memory 28. In some situations, e.g., when synthesizer 16 is used as a peripheral device for a general purpose computer instead of being operated in a real-time mode, it is useful to calculate a known number of samples in a burst for storage or for further processing. It is then advantageous to single-step the synthesizing process in a synchronous fashion. This effect is produced by inhibiting writing operations in appropriate steps of the basic program so that the oscillators receive no changes in their amplitude and/or frequency ramps, and hence the oscillator output amplitudes and/or frequencies remain unchanged. On each overflow from counter 99, counter 100 is enabled, if enabling input from PROM 101 is also present, to assume one of plural counter states directed by computer 13 via bus 19 from bits 9–11. Three illustrative counter states are as follows:

0=all processes are off, i.e., no OSC PHASE words or ramps are modified (no oscillator output)

1=calculate OSC PHASE words only (oscillator outputs have fixed frequency and amplitude)

2=calculate OSC PHASE words and ramps (oscillator outputs change in frequency and amplitude).

The counter 100 outputs partially address memory 101, and the remaining address is provided by program counter signals CNTϕ-4 which are continually changing as that counter operates. SPEC WRITE signals are thus produced for use in ROM C LOGIC of FIG. 8 for generating the aforementioned 8-WRITE HOB and 8-WRITE LOB signals for RAM 28. Such writing control signals are applied in appropriate RAM 28 write times of the basic program (FIG. 11), to effect the various single-stepping purposes specified by counter 100 outputs.

Two of the three output bits from counter 100 are also applied to two inputs of a multibit driver 102. Two additional inputs to that driver are provided from the Q-outputs of a pair of D-type flip-flop circuits 103 and 106, respectively. The flip-flop circuits are also clocked by the 7-CLK CON REG signal to sample the bits 7-FB14 and 7-FB15 on the aforementioned bus from the computer 13. Flip-flop 103 can be preset by a 9-SET FLAG control signal and reset by a 7-CLEAR FLAG control signal. The flip-flop 106 is cleared by the 9-CLR INT ENAB signal. Thus, flip-flops 103 and 106 are the structure through which the synthesizer controls the RMP DN and INT EN (FIG. 5D) signals and through which computer 13 (bits FB15 and FB14) can do the same.

The Q-output of the flip-flop 106 also provides the MASTER ENAB control signal. Driver 102 is operative when actuated by the control signal 7-ENAB CONWD for coupling the outputs of flip-flops 103 and 106 and the two low-order bits from counter 100 as the four high-order bits TB12–15 of a T-bus extending through a transceiver 107 back to the computer 13.

Figure 7:
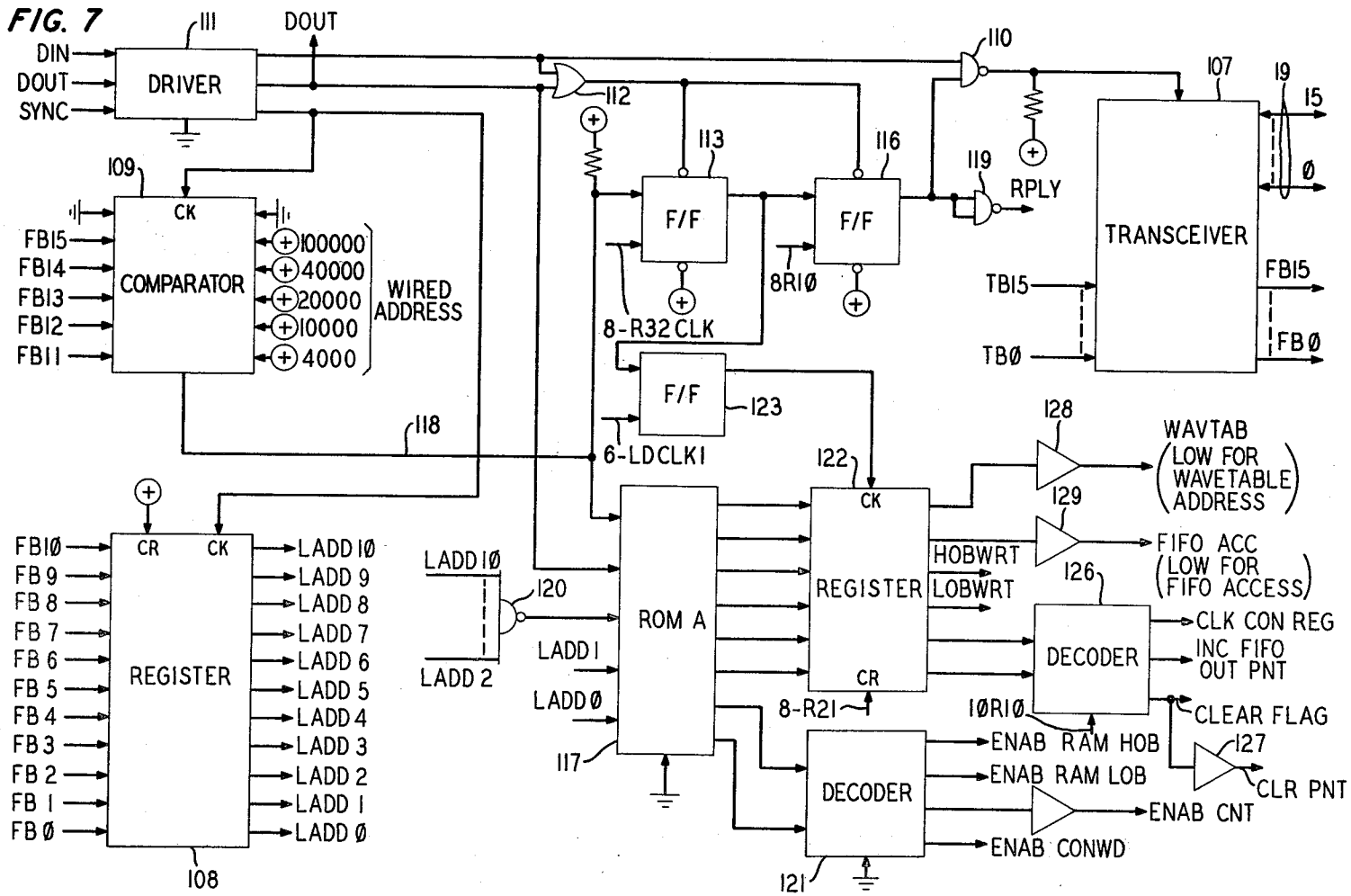
FIG. 7 is a schematic diagram of circuits for interfacing the synthesizer operation with a computer of FIG. 1.

FIG. 7 contains the details of computer-synthesizer interface logic contained in the synthesizer 16 but not specifically shown in the synthesizer data paths of FIG. 4. In this figure, a 16-bit bidirectional circuit, or transceiver, 107 has interface connections for the 16-bit bidirectional bus 19 that is coupled to the computer 13. The transceiver 107 also includes a T-bus for receiving data signals TBϕ-15 to be coupled from the synthesizer 16 to the computer 13 and a similar F-bus for coupling data and address signals FBϕ-15 received from computer 13 to various circuits of the synthesizer 16. For this purpose, the bits FBϕ-15 are applied to a flip-flop register 108 for bits FBϕ-1ϕ and a comparator 109 for bits FB11–15. The transceiver 107 normally couples data from the bidirectional multiconductor bus 19 to the F-bus; but, upon application of a control signal from the output of a NAND gate 110, the register 107 changes its mode of operation and couples signals from the multiconductor T-bus to the bidirectional bus 19. Conductors of the F-bus are also applied to the three-state latch registers 20 and 21 of FIG. 4 with the bit groupings already described in connection with that figure. Signals for the T-bus are supplied by latches 63 and 66 in FIG. 4, or by the FIFO counter drivers 69 and 70, also mentioned in connection with FIG. 4.

A driver 111 couples three different signals, part of bus 19, directly from the computer 13 into the synthesizer 16 for helping to control interface functions. To this end, a DIN data input control signal from the computer is applied to one input of the NAND gate 110 and to an input of an OR gate 112. Driver 111 also couples a DOUT signal from the computer to another input of the gate 112, as well as providing a DOUT signal for use elsewhere in the synthesizer. Gate 112 couples either of the DIN and DOUT signals for resetting two D-type flip-flop circuits 113 and 116. Finally, the driver 111 couples a SYNC signal from the computer for enabling F-bus inputs to be coupled into the comparator 109 and the register 108.

Output from the register 108, designated LADDϕ-10, is utilized for partially addressing a read-only memory (ROM) 117, further designated ROM A, which provides various control signals as will be described. In addition, the comparator 109 examines the high-order bits FB11-15 of the F-bus to determine whether or not they match a predetermined wired address illustratively indicated as the address 174000. When a match occurs, it indicates that the computer 13 is seeking communication with synthesizer 16, and the match signal appears on a lead 118. That signal is sampled by the flip-flop 113 when it is clocked by the program 8-R32 CLK control signal. On the next program cycle, the output of the flip-flop 113 is sampled by the flip-flop 116 during the program step 8-R1ϕ signal; and the output of that flip-flop 116 is utilized for actuating the NAND gate 110 to change the directional mode of operation for transceiver 107 so that the computer can take data in from the synthesizer if DIN is a ONE. In addition, the output of flip-flop 116 actuates a further NAND gate 119; and the output of that gate is the RPLY control signal which is transmitted directly, in bus 19, to computer 13 to advise it that reply data has been set up for coupling through the transceiver.

The match signal on lead 118 is also utilized as the most significant address bit for the read-only memory 117. Additional address bits for ROM A are provided directly by the LADDϕ-1 bits from register 108 and by the output of a NAND gate 120, which indicates coincidence of binary ONE states in the bits LADD2-1ϕ from register 108, as well as an additional address bit represented by the DOUT signal from driver 111. ROM A helps to perform the logic necessary to recognize which region of RAM 28 is being accessed by computer 13. A low signal from 120 means one of the special registers is being accessed. Only if the FIFO output is accessed (known by the state of LADDϕ and LADD1) will the RAM 28 supply the data. Otherwise, other registers will supply the data.

Address signals applied to ROM A access any one of 32 8-bit words as a function of conditions specified by the computer 13. Those words are used to generate various synthesizer control signals. Thus, the two low-order bits of the ROM A output are applied to a decoder 121 for selecting one of the four output control signals ENAB CONWD, an inverted signal designated ENAB CNT, ENAB RAM LOB, and ENAB RAM HOB. The remaining six higher order output bits from ROM A are coupled into a D-flip-flop register 122 when that register is clocked by the output of a flip-flop circuit 123 which samples the output of the flip-flop circuit 113 on each periodic clock signal 6-LDCLK1. The sampled bits in register 122 are utilized for different purposes prior to that register being cleared by the 8-R21 program step control signal. Two of the output bits from register 122 comprise selection signals employed by a decoder 126 to produce one of three control signals. Those three are CLEAR FLAG, INC FIFO OUT PNT, and CLK CON REG. The CLEAR FLAG signal is also coupled through an inverter 127 to become the CLR PNT control signal. Two further outputs of register 122 are the write control signals designated LOB WRT and HOB WRT to help generate write controls for memory 28. The final two outputs of register 22 are coupled through inverters 128 and 129 to become the WAVETAB and FIFO ACC control signals, respectively. The former is low for wavetable address, and the latter is low for FIFO access.

Figure 8:
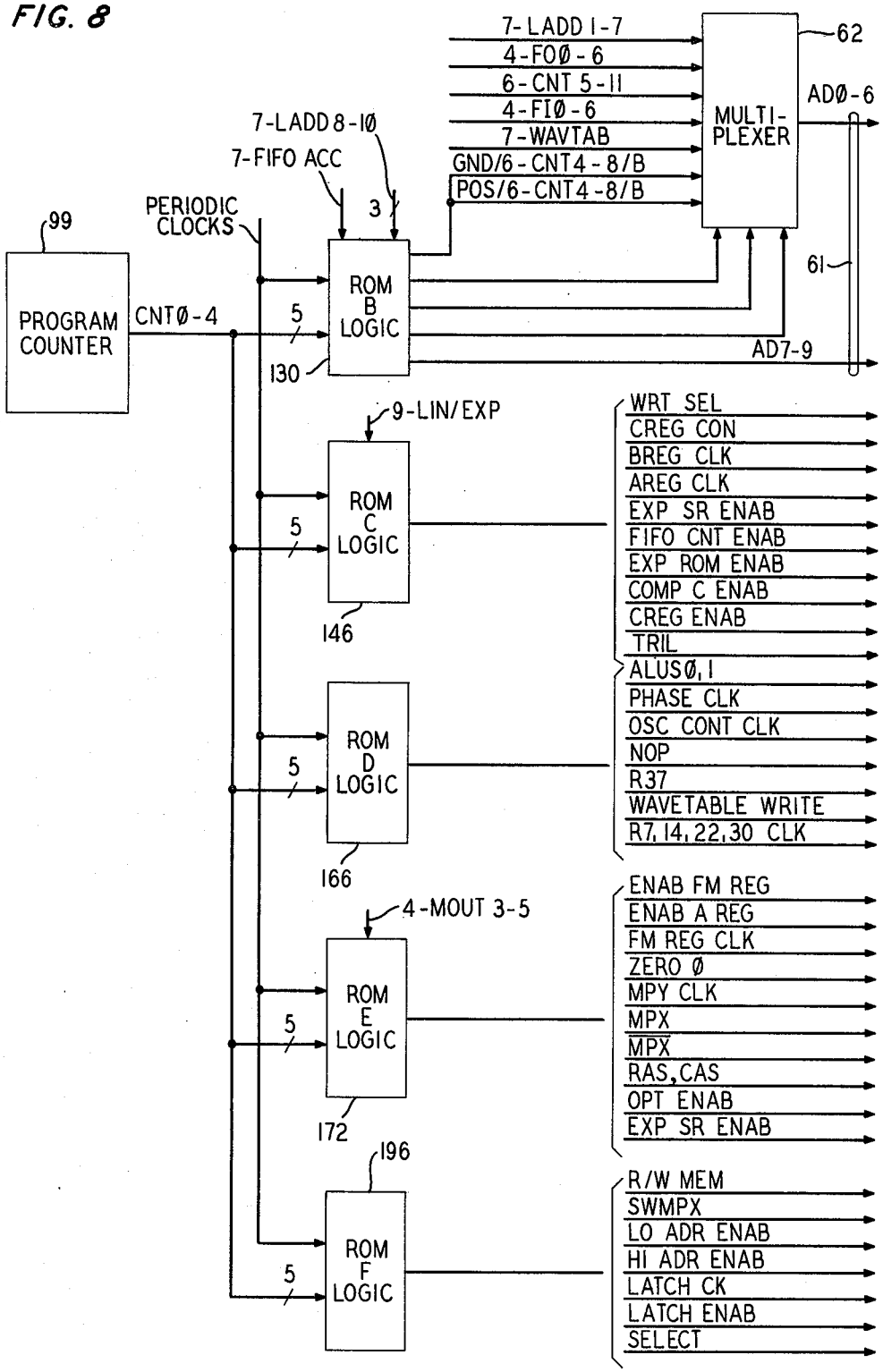
FIG. 8 is a simplified diagram of read-only memory logic for producing various control signals which determine the utilization of the data paths depicted in FIG. 4.

FIG. 8 illustrates the utilization of the five least significant bits of the output from the program counter 99 to address five read-only memories B through F which produce the clocked control signals employed as hereinbefore described in FIG. 4 and in some cases in other figures. In the case of each of the read-only memories, some of the indicated output signals result directly from addressing that memory and others of the output signals are derived by conventional associated logic to secure operation of the FIG. 4 circuits in accordance with the FIG. 11 timing diagram. Since there are many ways known in the art to configure read-only memories and associated logic to effect the operation of control circuits in accordance with a given program timing diagram, details of such logic are not discussed herein. Accordingly, FIG. 8 shows simply the program counter and the five sets 130, 146, 166, and 172, and 196 of read-only memory logic driven by output signals from corresponding addressed read-only memories, not separately shown, to produce the indicated control signals for utilization as previously described in connection with FIG. 4 and other figures. Various periodic clock signals from the circuits of FIG. 6 are indicated in FIG. 8 simply as "periodic clocks" applied to the five sets of read-only memory logic.

ROM B logic 130 is primarily concerned with providing address signals to the RAM 28. Five bits of address in the form of the counter signals CNTϕ-4 are applied to a ROM in the logic 130 for selecting one of up to 32 different ROM output words which call for various ones of different possible RAM 28 address signal configurations represented in the ten address bits ADϕ-9. Each output from the ROM B logic 130 includes three bits defining an input signal set selection for the multiplexer 62. Thus, that multiplexer is caused to select among six different address signal sources for producing the address bit group ADϕ-6. The various multiplexer selection code values, input signal sources, and synthesizer functions addressed are indicated in the following Table I:

TABLE I

| SELECT CODE VALUE | INPUT SIGNAL SOURCE | SIGNAL FUNCTION |
|---|---|---|
| 0 | 6-CNT5-11 | Ramp numbers |
| 1 | 7-WAVETAB | Refresh/wavetable |
| 2 | 4-FI0-6 from input pointer counter 68 | FIFO input address |
| 3 | (unused) | |
| 4 | Ground for AD0, 6-CNT4-8 for AD1-5, and a bit from ROM B for AD6 | A or C oscillator |
| 5 | Positive for AD1-5, 6-CNT4-8 for AD1-5 and a bit from ROM B for AD6 | B or D oscillator |
| 6 | 4-FO0-6 from output pointer counter 67 | FIFO output address |
| 7 | 7-LADD1-7 | Computer access address |

The source selected by the coded value 1 is a single bit in the least significant bit position of the multiplexer, with other bit positions grounded; and it in combination with address bits AD7-9, causes the RAM 28 to be addressed at the wavetable word 3400 in FIG. 5A for one binary state of the bit and to be addressed at the refresh phase location 3402 for the other state of the bit. The three address bits AD7-9 are provided directly from the ROM B logic 130 output at all times and represent either three bits of the output of the read-only memory in the logic or three bits of address 7-LADD8-1ϕ provided from computer 13 information. The selection of which source to use for those three bits advantageously depends upon the states of two other bits in the output of that same read-only memory and the state of the 7-FIFO ACC signal provided from the ROM A in FIG. 7.

ROM C logic 146 produces numerous signals for different functions to be controlled in FIG. 4 as indicated in the signal listing in FIG. 8. This logic generates the indicated WRITE SEL signals used in FIG. 9 to control writing to the RAM 28 in FIG. 4. The logic utilizes the 9-LIN/EXP signal which indicates whether linear or exponential format should be used for a ramp signal and thus controls the selection of one of the registers 27 or 40 to provide that signal.

The ROM D logic 166 produces various R-program signals, only a few of which are listed, periodic R-program step signals, e.g., R37, and the related R-CLK program clock signals, e.g., R7, 14, 22, 30 CLK. These program signals are used throughout the various ROM logic circuits and in other circuits to effect operation according to the FIG. 11 timing diagram. In addition, the logic 166 produces the ALU Sϕ, 1 signals for determining periodically the functions to be performed by the ALU 29 in FIG. 4. Similarly, the WAVETABLE WRITE signal periodically enables writing into the memory 23 of FIG. 4 at program times R1, R2, and R3, if computer 13 requests such action. The PHASE CLK and the OSC CONT CLK signals are also utilized in FIG. 4. PHASE CLK signals appear at program times R6, 14, 22, 30, and 35; and OSC CONT CLK signals appear at program times R4, 12, 20, and 26.

ROM E logic 172 produces, with the cooperation of the 4-MOUT3-5 signals from RAM 28, four register-related signals ENAB FM REG, ENAB AREG, FM REG CLK, and OPT ENAB to coordinate the operation of those registers with the operation of multiplier 47 and with the addressing of the wavetable memory 23 by means of address signals also supplied from RAM 28 on the same bus 31. Also supplied from the ROM E logic 172 are the ZERO $\phi$ for multiplexer 79 in FIG. 4, clocks for multiplier 47, MPX and RAS, CAS strobe signals for wavetable memory 23, as well as the EXP SR ENAB signal for the shift register 27.

ROM F logic 196 produces periodically recurring signals related to operation of switch memory 50. These include R/W MEM to indicate whether a read or write operation is to be performed, loading clock and output enabling signals for latch register 71 which supplies data to memory 50, and the address selection signals for latches 72 and 78 and multiplexer 79.

As indicated in connection with logic 166, FIG. 9 illustrates a way for determining whether or not a ramp has overflowed and, if it has, what ramp value should be written back into memory 28 and what communications should be made to computer 13 and to the FIFO sector of RAM 28. There are various possible combinations of decisions depending on the state of the FIG. 11 program and the character of sound to be produced at any given moment. Thus, data sign information in a register 159 and ramp control word information in a register 161 are used to address a PROM 160 for selecting the proper set of decisions for the different combinations of circumstances.

The D-flip-flop register 159 includes five flip-flops, further designated as a-e, which are clocked three times on the successive program steps R2-4 to sample their respective inputs. The latter inputs comprise, from the top, the d-flip-flop output, the c-flip-flop output, the FIG. 4 A-bus sign bit 23, the FIG. 4 ALU most significant (sign) output bit 23, and the b-flip-flop output. Following the three samplings at 8-R2-4 CLK the five output bits of register 159 are sign bits for different functions useful in determining ramp status. Thus, taking these output bits in sequence from the bottom toward the top of the register 159 as illustrated, they comprise the NEW ALU output signal sign from the previous clock period, FINAL-NEW ALU output sign from the present clock period, FINAL VALUE A-bus sign from the present clock period, INCREMENT sign (being the FINAL VALUE sign from the previous clock period), and OLD VALUE sign representing the sign of the A-bus value from the second previous clock period. The five outputs of register 159 are used to control ramp-end logic, i.e., as the low-order-bit portion of the address for the programmable read-only memory (PROM) 160 which contains 256 three-bit words.

Three additional high-order address bits for the PROM 160 are provided from the flip-flop register 161. That register is clocked at the program step signal 8-R21 for sampling the memory 28 output bits MOUT7, 22, 23. The significance of the latter bits was explained in regard to FIG. 5C and is further indicated by corresponding legends on the output circuits of the register 161 in FIG. 9.

The PROM 160 contains a state table for dealing with ramp generator overflow as will be described in connection with the FIG. 11 timing diagram. Each word of the table defines what actions must be taken for a different PROM address signal combination. In each of the three PROM output word bits, one bit is the ENAB CREG CLK control signal, and the other two bits are sampled through a 2-flip-flop register 162 on each 6-DATA CLK periodic clock to produce two sets of complementary control signals, respectively. One of those two bits becomes a true signal which is utilized as the ENAB FIFO PUSH control signal, and the corresponding complementary control signal is the SET FLAG signal. The second flip-flop of the register 162 produces, as the complementary output signal, the CLEAR INT ENAB control signal; and it produces a true signal which gates the 6-MASTER ENAB signal through a NAND gate 163 to become the INT REQ signal which is coupled directly to the computer 13 for requesting an interrupt. Also shown in FIG. 9 is write control logic responsive to two bits of WRITE SEL signals from ROM C logic in FIG. 8. A dual data selector 156 has two sets of four input signals, and one signal from each set is selected by the WRITE SEL signals for coupling through respective inverters 157 and 158 to produce the WRITE HOB and WRITE LOB signals used in FIG. 4. The selectable input pairs include 7-HOB WRT and 7-LOB WRT at program time R5 for computer 13 access, ground and ENAB FIFO PUSH to write the FIFO storage at program times R27 and R36, 6-SPEC WRITE in both sets, and ground in both sets for no writing.

Figure 10:
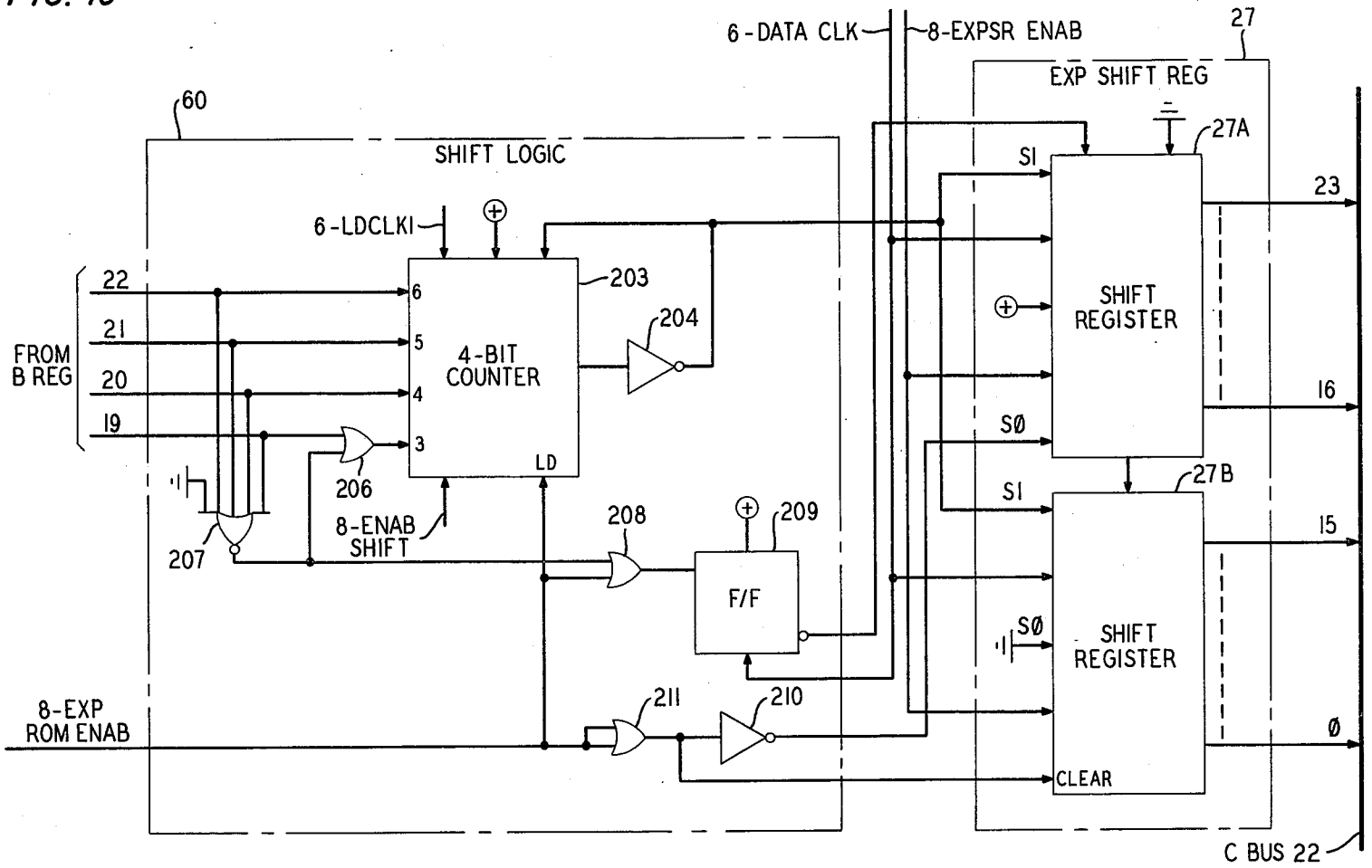
FIG. 10 is a schematic diagram depicting an embodiment of the linear-to-exponential code-converting logic employed in the synthesizer of FIG. 4.

FIG. 10 illustrates some additional detail of the circuits indicated in FIG. 4 for accomplishing the linear-to-exponential code conversion. During program time R3, the B-register 36 contains a current ramp value to be exponentiated by the circuits of FIG. 10. The four most significant magnitude bits 19–22 of the B-register output are applied to shift logic 60 to be used as an exponent value for controlling the shifting of register 27. Three most significant ones of those four bits are loaded directly into the three most significant stages of a binary counter 203. The least significant of those four bits is applied to an input of an OR gate 206 which has at its other input the output of a NOR gate 207. Thus, the output of OR gate 206 is high either when bit 19 is high or when all of bits 19–22 are low, and that output is applied to the least significant stage of the counter 203. That counter is loaded upon occurrence of the 8-EXP ROM ENAB signal, and the appearance of the 8-ENAB SHIFT signal allows the periodic 6-LDCLK1 signal to increment counter 203 until it overflows at its ripple carry output through an inverter 204 to disable further counter operation. The same output of inverter 204 is applied as one enabling input S1 to the shift register 27.

Shift register 27 includes two tandem-connected parts, one of which, 27A, may be parallel loaded and the other, 27B, may be cleared. Upon either of a high output from the NOR gate 207 or the high state of the 8-EXP ROM ENAB signal, an OR gate 208 is actuated, and its output is sampled to set a flip-flop circuit 209 upon occurrence of the periodic 6-DATA CLK signal. The complementary output of that flip-flop provides the serial data input to the shift register 27 and has the effect of inserting into the shift register most significant bit position 23 a binary ONE followed by binary ZEROs as counter 203 is operated.

The same 8-EXP ROM ENAB signal is also coupled, after a slight delay in an OR circuit 211 and an inverter 210, to provide a second enabling input Sϕ to the part 27A of shift register 27. When both of the enabling signals Sϕ and S1 are in their high binary signal states, register part 27A only is loaded from the C-bus. The most significant 8-bit part 27A of the shift register shifts, in response to 6-DATA CLK signals, to the left (toward its LSB position) when Sϕ is low and S1 is high; and it shifts to the right, i.e., away from the least significant bit portion when Sϕ is high and S1 is low. If Sϕ and S1 are both low, e.g., when counter 203 overflows, register 27 holds its signal content. The 16-bit least significant part 27B of register 27 has its Sϕ enabling input continuously grounded so that it shifts only to the left, i.e., toward the part 27A. The output of OR gate 211 is also applied to the clearing input of shift register part 27B to clear that part each time the register 27A is parallel loaded with the exponential form of B-register bits 1ϕ-18 after conversion by ROM 59. 6-DATA CLK periodic clock signals provide simultaneous shift clock to both parts 27A and 27B to right shift the contents until counter 203 overflows indicating that the fully exponentiated value from register 36 has been formed. The 8-EXP SR ENAB enables bit-parallel output from the full shift register 27 to the C-bus, if the exponentiated format is to be utilized.

In FIG. 11 there is shown a timing diagram depicting the principal functions of synthesizer 16 at each step of the basic 32-step program which is recurrently driven by the output bits CNTϕ-4 of program counter 99. The program steps indicated in the left-hand column of the diagram are designated Rϕ-R37 in octal notation, and the corresponding control and clock signals are produced by circuits of ROM D logic 166 in FIG. 8. Functions of key synthesizer circuits are indicated in the eight columns of the timing diagram as hereinafter defined.

The column RAM ADDRESS includes the names corresponding to word locations in main memory 28 which are read out of or written into at address signals applied from the multiplexer 62 under control of the program counter bits CNTϕ-4. A writing operation is designated by a cross-hatched vertical bar at the right-hand side of the corresponding address step. If the bar has double cross-hatching, e.g., as at times 5 and 36, it indicates that a conditional writing operation is to be performed, with the decision as to whether or not to write being made by particular logic circuits of the synthesizer 16.

The column A REG identifies the types of data values which are assertable on the A-bus 32 in the synthesizer. These values are usually provided from the contents of the A-register 30 although in some cases the value is one which has been read out of the switch memory 50, for temporary storage in the FM REG 86, from which it is then controllably asserted onto the A-bus. Similarly the columns B REG and C REG contain names identifying values to be found in the B- and C-registers, respectively, at the indicated program steps. A small arrowhead pointing to the left in the upper right-hand corner of a box in one of the three register columns indicates that the register is clocked for loading at the beginning of that program step. If the arrowhead is circled, e.g., at time 7, in the C REG column, it indicates an optional clocking of the data into the C-register depending upon the state of the output signal from data selector 41.

The column ALU FUNCTION indicates the function to be performed by the arithmetic unit 29 with respect to values provided at the A- and B-inputs thereof, i.e., usually values provided from the A- and B-registers, respectively. The indicated functions are performed with respect to signals appearing as indicated in the same program step.

Four signal waveforms are shown in two different columns of the timing diagram. In each case a high signal is indicated by a waveform excursion toward the right as illustrated in the diagram. Positive-going transitions are used to clock the multiplier, and negative-going transitions are used to clock data for memory circuits. In the column WAVEFORM MEM are the waveforms for the memory 23 control signals RAS and CAS for strobing addresses into internal address latches of the memory circuits. A bar-tipped arrowhead pointing to the left between certain steps of the program in this column signifies that the control signal clocks the address input to the wavetable memory 23 address latch registers so that the memory 28 read out from a prior step, e.g., an OSC ϕ or a REFRESH PHASE, will be stored in those latches, as well as the A-register, in the transition to the next program step. Thus the output of an OSC ϕ word or a REFRESH PHASE word addresses the wavetable memory. In the column MPY CLKS are two additional waveforms XCLK and M, Y, and L CLK. These waveforms are the control signals supplied from the counter-driven ROM E logic 172 to strobe various functions of multiplier 47 as already described.

At the SWITCH MEMORY ADDRESS column are the names of oscillator control word fields, as in FIG. 5B, in main memory 28 which are used to address the switch memory 50. These field names have appended the designation of one of the four oscillators A-D being operated in a particular program cycle as hereinbefore generally discussed in connection with FIG. 3. Where no field is specified in this column, the address used is automatically octal 17 as previously noted. Once again, a cross-hatched vertical bar at the right-hand side of the program step in this column indicates an operation in which the addressed switch memory location is to be written.

In the initial step Rϕ of the program represented by the FIG. 11 timing diagram, a value REFRESH PHASE is written into the random access memory 28, this value being an incremented address obtained in step R37 of a prior cycle of the program. This aspect of the program is needed because the wavetable memory 23 is advantageously a dynamic memory and the contents thereof must be periodically refreshed by reading. For this purpose that memory 23 is read during program steps R37 through R6 at a location indicated by the contents of location 3402 in memory 28. Such address read from memory 28 in step R35 was also loaded into the A-register and held during program steps R36 and R37. In step R34 an ALU CLEAR output was produced and used in step R35 to ZERO the B-register. Bit 1ϕ in that register corresponds to the LSB of a 14-bit address for memory 23, and it is forced to ONE in step R37 by OR gate 38 at the B-input of ALU 29. The resulting sum is the incremented REFRESH PHASE value, i.e., the new refreshing address for memory 23 which will be used during the next program cycle; and it is clocked into the C-register from which it is used in the aforementioned Rϕ program step. If computer 13 has requested a write to memory 23 prior to the beginning of the refresh steps, ROM 28 wavetable address location 3400 will be used as the wavetable address. This is accomplished by ROM A generating signal WAVETAB going to address multiplexer 62. The data in latch 20 in FIG. 4 is then asserted on C-bus 22 and write logic control from ROM D logic 166 causes the data to be written into memory 23 during steps R37-R6. The address at 3400 in ROM 28 is also incremented as previously described for the REFRESH address. The WAVETAB signal is cleared so that during the next program cycle address 3402 will once again be used to address memory 23, and no write to memory 23 will occur.

A substantial part of the FIG. 11 basic program cycle is devoted to performing ramp calculations for a different particular ramp during each successive program cycle. For this purpose in program step R1 a word CURRENT RAMP VAL, for a ramp specified by program counter 99 output bits CNT5-11 applied to multiplexer 62, is read from memory 28 while the ALU 29 is being forced to a CLEAR, i.e., all-ZERO, output state. In step R2 that value is clocked into the A-register and added to an all-ZERO word clocked into the B-register while the ALU output was still CLEAR at the end of step R1. Also in step R2 a word RAMP INC, i.e., the incrementing magnitude for the same ramp, is read from memory 28, and then clocked into the A-register during step R3 while the previous contents of the A-register are clocked into the B-register. Also during this step the ALU adds the contents of the A- and B-registers, and during the step R4 the resulting sum, i.e., the incremented ramp value, is clocked into the B- and C-registers.

The final RAMP VAL, read in step R3 and clocked into the A-register at the start of step R4, has subtracted from it the incremented ramp value, in the B-register, to effect a comparison of amplitudes. The sign of the difference is used in ramp overflow logic of FIG. 9 as an indication of whether or not the ramp has reached its final value. In step R5 the ALU is cleared to set up ZERO in the B-register in R6, and a conditional write operation is performed which allows the computer 13 to have access to memory 28 if the computer has provided the necessary control signals to effect that result.

In program step R6 the B-register is loaded with the all-ZERO word, and the contents of the A- and C-registers remain the same. Thus, the A-register contents are at this time added to the ZERO in the B-register, and the sum is conditionally clocked into the C-register as the NEW CURRENT RAMP VAL during program step R7. During steps R2-4 sign information is being clocked into register 159 of FIG. 9 to determine whether or not the ramp has reached its final value and whether to use as the NEW CURRENT RAMP VAL the INCREMENTED RAMP VAL already in the C-register or the FINAL RAMP VAL (in the A-register). Only if the final value is required, is R7 clocked into the C-register. During step R4 the INCREMENTED RAMP contents of the B-register had been applied to the exponentiating circuits 59 and 60 so that the exponential form thereof is available in shift register 27 by the step R37.

Also in the step R7 the C-register contents are written into memory 28 as the CURRENT RAMP VAL.

No further ramp calculations, except possible exponentiating operations, are performed until step R21 when the ramp control word, FIG. 5C, is read out of memory 28 for use by the ramp overflow logic of FIG. 9 in determining whether or not to generate an interrupt request to computer 13 and how to control the ramp-end FIFO. At the beginning of R22, the ENAB INT, ENAB FIFO, and the RAMP FLAG are applied to the input of PROM 160. The code in PROM 160 generates the ramp control signals. At the end of R22, the control signals are loaded into register 162 by 6-DATA CLK. At R23 time, INT REQ will be generated if 6-MASTER ENABLE is high and the ramp-end logic has determined that the ramp should generate an interrupt request. The interrupt enable is cleared by the complementary signal so that only one interrupt is set to the computer. At R27 time, the ENAB FIFO PUSH signal is used to control a conditioned write of the RAM CONTROL WORD bits ϕ-7 into RAM 28 by write control logic also in FIG. 9. The data selector 156 applies the ENABLE FIFO PUSH signal to control writing of the low-order byte of the ramp control word. At program step R27 RAMP CONTROL is thus conditionally written back into memory 28 from buffer register 43 in FIG. 4A. This allows use of CNTϕ for setting the ramp complete bit 7 (FIG. 5C). Control bits ϕ-6 are overwritten by CNT5-11 at the same time but their states are irrelevant in this phase of the program because all four words of the completed ramp must receive new data before further use.

In program step R34 a word CURRENT RAMP VAL is read from memory 28, and it is the same value which had been written into the memory in program step R7. In step R35 this value is clocked into the A-register, and the all-ZERO word is clocked into the B-register. The ALU performs an A+B function during step R35, and in step R36 the result of that addition is clocked into the C-register. Also at R36, the ENAB FIFO PUSH signal is used to conditionally enter the ramp number (via buffer 43, FIG. 4A) into the FIFO storage area. In the final step R37 a word RAMP OUTPUT is written into memory 28 utilizing either the CURRENT RAMP VAL linear form from the C-register or the exponentially expressed ramp value, residing in the exponential shift register 27 since early in the cycle, as determined by control signals MOUT 21 of the ramp control word which has been held in a stage of register 161 in FIG. 9 since R21. The writing location is either the OSC MPY COEF location or the OSC FREQ location, as appropriate, for the oscillator to which that ramp is assigned. At R37 time, register 161 (in FIG. 9) is cleared so that at Rϕ time, the output of register 162 returns to the normal state. If an ENAB FIFO PUSH signal had been present, the high-to-low transition of this signal increments the FIFO input pointer counter 68.

During each cycle of the program depicted in FIG. 11 a different set of four oscillators A-D, as indicated by program counter 99 output bits CNT4-8 at multiplexer 62, are calculated. For illustrative purposes it is necessary at this point to consider only, e.g., the A-oscillator. In step R4, processing for the A-oscillator begins by reading out the word A OSC CONTROL. Bits 8-23 are applied to the latches 72 and 76 to provide address information for switch memory 50 bits ϕ-2 to data selector 80 to control the selection and configuration of the wavetable memory 23 for that oscillator, and three additional bits 3-5 to various circuits to control the multiplier 47 X- and Y-input selections, i.e., the switch functions shown in FIG. 3. In step R6 the word A OSC $\phi$, i.e., OSC PHASE in FIG. 5A, is read from memory 28; and it is clocked into the A-register in the beginning of step R7, though it is actually used as the ALU input in step R1$\phi$. That same OSC $\phi$ value is also clocked into the memory 23 address latches to start accessing that memory for a readout that will be ready at about R14. Meanwhile, various input data alternatives for multiplier 47 are being set up, multiplier 47 and adder 49 operations for a different oscillator are going on, and the new memory 23 address for the next sample time is being calculated. This OSC $\phi$ word currently being used to address wavetable memory 23 is susceptible to being modified for frequency modulation by the time of its next use as will be described.

In step R7 the A OSC FM (FM REGISTER address in FIG. 5B) readout resulting from the addressing of the switch memory 50 during step R6 is clocked into the FM REG 86 from which it is available on the A-bus 32 (listed in the A REG column of FIG. 11). Also in steps R6 and R7 the B-register is ZEROed, and during step R7 the value A OSC FM is added to B-register zero and the sum clocked into the B-register during step R1$\phi$ to be available for adding to A OSC $\phi$, now in the A-register, to effect a frequency-modulating address change. Also during R7 the switch memory is addressed by the value in the OPTION REGISTER field of the A-oscillator control word, and the output from memory 50 resulting therefrom is clocked into the option register 83 to be available as an optional X-input to multiplier 47.

Now in step R1$\phi$ the sum of the A- and B-register contents is clocked into the B-register as the value $\phi$+FM (the previously mentioned frequency modulation), and at the same time a value A OSC $\Delta\phi$, otherwise designated OSC FREQ in FIG. 5A, which had been read from memory 28 in program step R1$\phi$, is in step R11 clocked into the A-register. This is the ramp-generated oscillator phase (memory 23 address) change element. The contents of the A- and B-registers are added to enable the resulting sum to be stored in the C-register during program step R12 as the value $\phi$+FM+$\Delta\phi$. That latter value is the final address calculated to be available in RAM 28 for later use during the next sample period in accessing the memory 23. Also in steps R11 and R12 the A OSC COEF (OSC MPY COEF in FIG. 5A) is read and stored in the A-register 30.

Multiplier 47 input alternatives are selected (X from memory 23 or register 83 and Y from register 30 or register 86) in program time R13 and clocked into the multiplier internal input registers by the MPY X CLK (at the end of R13) and Y CLK (at the end of R12). The resulting multiplier product is clocked into the multiplier internal output registers at time R2$\phi$ by the MPY L and M CLK signals, and in R24 it is applied as one input to adder 49 along with the switch memory 50 contents that had been read out by the A ADD INPUT address during steps R23 and R24. The sum is stored in the latch register 71 to be written back into the switch memory 50 during step R25 at the address specified by the A ADD OUTPUT field.

Oscillator outputs are advantageously combined to realize desired sound effects by appropriately specifying ADD INPUT and ADD OUTPUT addresses in respective oscillator control words. Thus, all oscillators, except the last, of a group to be combined in a sample period use the same ADD OUTPUT register address in memory 50; and that is also the ADD INPUT address for all oscillators except the first of the group. The mentioned first oscillator uses as an input the all-ZERO register in memory 50, and the mentioned last oscillator uses as an output the register 178 in the memory. As previously outlined, that register is automatically addressed to read out at all times in FIG. 11 when memory 50 is not otherwise addressed.

The B-, C-, and D-oscillators are similarly calculated in remaining portions of the program cycle in a fashion much the same as that already outlined for the A-oscillator.

Although the present invention has been described in connection with a particular embodiment thereof it is to be understood that additional embodiments, modifications, and applications thereof which will be obvious to those skilled in the art are included within the spirit and scope of the invention.

I claim:

1. A synthesizer for producing digital pulse-coded signal samples corresponding to predetermined analog signal samples in response to received digital signals defining constituent tones of said analog signal samples, the synthesizer comprising means, responsive to digital amplitude control signals, for generating digital output signals representing corresponding analog samples of different ones of said tones, a ramp signal generator, responsive to said received digital signals, for producing sets of digital amplitude control signals to control said generating means for each of said tones, and means for combining selectable different outputs of said generating means to produce the first-mentioned digitally coded samples of analog signals.

2. The synthesizer in accordance with claim 1 in which said generating means is a time-shared digital oscillator, and means are provided for cyclically sequencing said oscillator through a predetermined fixed program using different sets of digital control signals from said ramp signal generator, said oscillator producing in each cyclic recurrence of said program a digital sample of at least one of said constituent tones.

3. The synthesizer in accordance with claim 1 in which said ramp signal generator comprises means for storing, in multi-word sets of locations for each of a plurality of ramp functions, digital signals defining the ramp function in terms of a control word, an accumulation increment magnitude word, a final ramp value word, and a current ramp value word; and means for recurrently sequentially accessing all of said sets of ramp words to process each set according to the steps of adding the current ramp value to the increment value, comparing the resulting sum value to the final value to produce a match signal in response to attainment of at least the final value, and if there is no match signal writing the sum word back into said storing means at the current ramp value word location and if there is a match signal generating a signal indicating termination of the ramp function.

4. The synthesizer in accordance with claim 3 in which said generating means is a time-shared digital oscillator, means are provided for cyclically sequencing said oscillator through a predetermined fixed program using different sets of digital control signals from said ramp signal generator, said oscillator producing in each cyclic recurrence of said program digital samples of a plurality of said constituent tones, and said sequencing means including means for processing a different set of said ramp words in each cycle of said program.

5. The synthesizer in accordance with claim 3 in which there are provided means responsive to a portion of said received digital signals for addressing said digital ramp signal storing means, and means for coupling another portion of said received digital signals as data for writing into said digital ramp signal storing means.

6. The synthesizer in accordance with claim 3 which comprises in addition means for queueing signals, responsive to the aforementioned ramp termination signals, in the form of the number of the respective terminated ramp function in the aforementioned recurrent accessing sequence, and means for transmitting a queued ramp termination signal on a first-in-first-out basis.

7. The synthesizer in accordance with claim 1 in which said digital signal generating means comprises means for storing digital sample amplitude signals of a predetermined signal wave as an addressable wavetable, means in said ramp signal generator, and responsive to said received digital signals, for producing sets of digital frequency control signals to control said generating means, means, including said frequency control signal of one of said ramp generator signal sets, for addressing said digital sample storing means, said digital signal generating means further including means for multiplying successive digital sample signals from said digital sample storing means by corresponding digital amplitude control signals from a different one of said ramp generator signal sets, and said combining means comprises switch memory means including a plurality of digital registers, and means for selectively connecting an input signal port to one of said registers and selectively connecting an output signal port to one of said registers, the sequence for selection of said input port and output port connections for said registers being determined by said received digital signals, and means for adding a digital output word of said multiplying means to the digital signal contents of a predetermined register of said switch memory means to produce a digital signal representing one of said analog signal samples for storage in a predetermined register of said switch memory means.

8. The synthesizer in accordance with claim 7 which comprises in addition, means for substituting the contents of one of said switch memory means registers for a sample from said wavetable memory means to effect selectable multiplier input options.

9. The synthesizer in accordance with claim 7 which further comprises means for adding the contents of a further register of said switch memory means to the aforementioned ramp generator amplitude control signal to effect amplitude modulation of said analog signal sample.

10. The synthesizer in accordance with claim 7 which further comprises means for substituting the contents of a further register of said switch memory means for the aforementioned ramp generator frequency control signal at said multiplying means to effect frequency modulation of said analog signal sample.

11. The synthesizer in accordance with claim 7 in which there are provided means for coupling received digital signals as data for writing into said digital sample storing means.

12. The synthesizer in accordance with claim 7 which further comprises means for converting linearly coded digital signals to corresponding signals in exponential form, and means for selecting either said exponential form signals or said corresponding linear signals as data for writing into said digital ramp signal storing means.

13. In a sound synthesizing system, means, including a plurality of transducers, for transducing a plurality of mechanical movements into corresponding digitally coded data signals identifying a particular transducer and the character of movement thereof, each transducer and the character of movement thereof corresponding to a predetermined tonal sound, means for processing said data signals to produce a first set of digitally coded signals representing the same sounds in terms of control signals for a predetermined synthesizer, and digital synthesizer means, responsive to said first set of coded signals, for operating cyclically through a predetermined fixed program to produce a second set of digitally coded signals representing said same sounds in terms of digitally coded multibit characters each defining the amplitude of a different time sample of said sounds, said synthesizer means comprising means, responsive to digital amplitude control signals for generating digital output signals representing corresponding analog samples of different ones of said tones, a ramp signal generator, responsive to said first set of coded signals, for producing sets of digital amplitude control signals to control said generating means for each of said tones, and means for combining selectable different outputs of said generating means to produce the first-mentioned digitally coded samples of analog signals.

14. The synthesizing system in accordance with claim 13 in which means are provided for converting said amplitude samples into said sounds in sound real time with respect to movements of said transducers.

15. The synthesizing system in accordance with claim 13 in which said processing means comprises means for filtering said data signals received from said transducing means to eliminate redundant signals and signals representing change of less than a predetermined change magnitude threshold, and means, responsive to occurrence of filtered data signals at a rate outside of a predetermined range of rates, for modifying said threshold to bring said occurrence rate within said range.

16. In a digital sound synthesizer, means for providing functions of a plurality of digital oscillators, means for fixing at least one cyclical base signal waveform comprising a fundamental waveform of said sound, means, responsive to received digital signals, for storing digital oscillator function word sets, one for each of said oscillators, and each set including at least a coefficient word for fixing a predetermined modification of said base waveform for such oscillator, and means in said providing means, and responsive to each of said coefficient words, for separately modifying said base signal waveform of the oscillator corresponding to said set including such coefficient word to produce a digitally coded amplitude sample of a different constituent tone of said sound, said amplitude samples of each tone being produced at a rate at least equal to twice the highest frequency of said sound.

17. The synthesizer in accordance with claim 16 in which said waveform fixing means comprises means for fixing a plurality of cyclical base signal waveforms, each being a fundamental waveform of a different portion of said sound, and each of said oscillator function word sets includes a word portion identifying one of said plurality of waveforms for use by the corresponding oscillator.

18. The synthesizer in accordance with claim 16 in which said plurality of digital oscillators comprises a corresponding plurality of oscillator functions executed at a fixed sampling rate in different time portions of the operation of a single time-shared digital oscillator.

19. The synthesizer in accordance with claim 18 in which said waveform fixing means comprises a wavetable memory for storing a plurality of samples of different phases of said waveform, each of said sets includes an oscillator phase word, and means for recurrently applying said oscillator phase words in a sequence of said sets for addressing said wavetable memory to produce samples for said modifying means.

20. The synthesizer in accordance with claim 19 in which said word set storing means further includes means, responsive to said received digital signals, for storing plural amplitude control signal ramp word sets and plural frequency control signal ramp word sets, one set of each type for each of said oscillators, each of said sets defining a piecewise time segment of the amplitude or frequency envelope of a constituent tone of said sound, and means are provided for recurrently processing said ramp word sets in a sequence of such sets for producing and applying to said oscillator function word sets said coefficient words from said amplitude ramp word sets and a plurality of oscillator phase change words from said frequency ramp word sets, said recurrent processing means also processing said oscillator word sets to modify respective phase words to the extent of corresponding ones of said phase change words.

21. The synthesizer in accordance with claim 16 in which there are provided means for combining said amplitude samples of selectable ones of said tones, said combining means comprising a plurality of digital registers comprising a switch memory having an input port and an output port, means for selectively connecting said input port to one of said registers and selectively connecting said output port to one of said registers, means responsive to a control word in each of said oscillator function word sets for addressing said switch memory, means for adding respective outputs of said oscillators to predetermined outputs of said switch memory, and means for applying outputs of said adding means to said input port.

22. The synthesizer in accordance with claim 16 in which there are provided a clock counter for fixing a recurrent predetermined sequence for operation of said synthesizer, and means for addressing said word set storing means and including means, responsive to outputs of said counter, for recurrently selecting addresses for such storing means from a plurality of different sources, including at least said counter and said received digital signals, in a predetermined sequence in each cycle of said counter.

23. A synthesizer for producing digital pulse coded signal samples corresponding to predetermined analog signal samples in response to sets of received digital signals wherein each set defines a linear piecewise approximation segment of the envelope of a constituent tone of said analog signal samples, at least one group of said sets defining envelope amplitude segments, each of said sets define its corresponding envelope segment in terms of a value ramp having a current value, a final value, and a change, or delta, value that must be used at a predetermined processing rate to produce a stepped ramp, that processing rate being substantially higher than the set occurrence rate for such tone, means for recurrently processing said ramp signal sets to produce for each ramp a train of digital signal characters defining the ramp;

a digital oscillator recurrently operatable in response to amplitude control signals to produce digital samples of said tone, the operation rate of said oscillator being at least equal to said ramp processing rate, and means for coupling the digital signal characters resulting from the processing of an amplitude ramp set to control said oscillator to produce a corresponding tone envelope segment.

24. The synthesizer in accordance with claim 23 in which there are provided buffer storage means for storing each ramp character for utilization by said digital oscillator until a succeeding new character for the same tone is produced by said processing means.

25. The synthesizer in accordance with claim 23 in which said digital signal sets include frequency envelope defining sets and further include in conjunction with each discrete digital oscillator function a signal defining a current starting phase for such oscillator function, plural buffer storage means are provided there being one such means for each of a plurality of separate ones of said digital oscillator functions, each such buffer storage means being adapted for storing an oscillator function status signal set including at least an amplitude ramp output digital character, said current starting phase character, and a frequency defining character from the processing of a corresponding one of said frequency envelope defining sets, said processing means including means for recurrently processing oscillator phase changes by combining said current phase and said frequency characters to produce a new current phase character, and means for applying said new current phase characters for further controlling a corresponding one of said digital oscillator functions.

26. The synthesizer in accordance with claim 25 in which said digital oscillator comprises means for multiplying first and second digital signals to produce said digitally coded sample of said tone, a wavetable memory storing a plurality of differently phased digitally coded amplitude samples of a fundamental wave cycle of said sound, said memory having an output thereof coupled to one input of said multiplier, means for addressing said wavetable memory in response to said new current phase word of an oscillator status signal set to produce a corresponding sample of said basic waveform, and means for applying said amplitude ramp coefficient character to said second input of said multiplier.

27. The synthesizer in accordance with claim 23 in which said received digital signal sets include in time-multiplex the ramp signal sets for a plurality of tones as well as a plurality of said oscillator status function signal sets and means are provided for operating said processing means and said digital oscillator in a predetermined recurrent sequence of ramp and oscillator signal set processing operations to produce one of said samples of each of said tones in each execution of said sequence.

* * * * *

UNITED STATES PATENT AND TRADEMARK OFFICE

CERTIFICATE OF CORRECTION

PATENT NO. : 4,201,105

DATED : May 6, 1980

INVENTOR(S) : Harold G. Alles

It is certified that error appears in the above-identified patent and that said Letters Patent are hereby corrected as shown below:

Column 1, line 44, "producing sound approaching the complexity of sound" should be deleted.

Column 1, line 48, "soundreal" should read --sound-real--.

Column 3, line 39, "9177" should read --1977--.

Column 3, line 65, "data" should read --date--.

Column 4, line 33, "lgorithm" should read --algorithm--.

Column 5, line 11, "not" should read --note--.

Column 5, line 29, after "loading" insert --actually takes place over a plurality of cycles of the--.

Column 6, line 4, "aformentioned" should read --aforementioned-

Column 6, line 59, "phass" should read --phase--.

Column 7, line 8 "not" should read --note--.

Column 7, line 20, "basis" should read --basic--.

Column 8, line 44, after "24" insert --bits--.

Column 9, line 11, "representatives" should read --representations--.

Column 11, line 2, "intializes" should read --initializes--.

Column 11, line 35, "mumber" should read --number--.

Column 14, line 68; Column 15, line 1, "1-2" should read --12--

Column 16, line 53, "7bits" should read --7 bits--.

Column 17, line 1, "CNTØ4" should read --CNTØ-4--.

Column 18, line 38, "10" should read --1Ø--.

UNITED STATES PATENT AND TRADEMARK OFFICE

CERTIFICATE OF CORRECTION

PATENT NO. : 4,201,105

DATED : May 6, 1980

INVENTOR(S) : Harold G. Alles

It is certified that error appears in the above-identified patent and that said Letters Patent are hereby corrected as shown below:

Column 20, line 13, "0" should read --Ø--.

Column 20, line 15, "0" should read --Ø--.

Column 20, line 18, "0" should read --Ø--.

Column 20, line 27, "0" should read --Ø--.

Signed and Sealed this

*Sixteenth* Day of *September 19*

[SEAL]

*Attest:*

SIDNEY A. DIAMOND

*Attesting Officer*

*Commissioner of Patents and Tradema*